US009924784B1

(12) United States Patent
Loso

(10) Patent No.: US 9,924,784 B1
(45) Date of Patent: Mar. 27, 2018

(54) TOOL HOLDER

(71) Applicant: Fred A. Loso, Minneapolis, MN (US)

(72) Inventor: Fred A. Loso, Minneapolis, MN (US)

( * ) Notice: Subject to any disclaimer, the term of this patent is extended or adjusted under 35 U.S.C. 154(b) by 0 days.

(21) Appl. No.: 14/530,097

(22) Filed: Oct. 31, 2014

Related U.S. Application Data

(63) Continuation-in-part of application No. 13/955,850, filed on Jul. 31, 2013.

(51) Int. Cl.
*A45F 5/02* (2006.01)

(52) U.S. Cl.
CPC ..... *A45F 5/02* (2013.01); *A45F 5/021* (2013.01)

(58) Field of Classification Search
CPC ..... B65D 43/16; B65D 43/164–43/167; A45F 2200/0575; A45F 5/021; Y10S 224/904; B25H 3/006
USPC ..... 220/817–819, 244, 836, 840, FOR. 190, 220/FOR. 191; 224/904, 660, 666–667, 224/268–269, 458, 537, 679; D3/228
See application file for complete search history.

(56) References Cited

U.S. PATENT DOCUMENTS 4,746,042 A * 5/1988 King ..... A45F 5/02 224/148.2
5,201,447 A 4/1993 Bumb et al.
5,489,051 A * 2/1996 Robinson ..... A45F 5/02 206/361
5,501,382 A 3/1996 Webb
5,540,363 A * 7/1996 Wilson ..... B44D 3/125 206/15.3
5,577,628 A * 11/1996 O'Neil ..... B65D 43/164 220/840
5,620,121 A 4/1997 Watson
5,687,892 A 11/1997 Johns
6,000,669 A 12/1999 Seward et al.
6,029,871 A * 2/2000 Park ..... A45F 5/02 224/197
6,062,449 A 5/2000 Kahn
6,065,658 A 5/2000 Hashimoto
6,105,838 A * 8/2000 Hansen ..... B26B 5/002 206/359
6,283,345 B1 * 9/2001 Butschat ..... A45F 5/02 224/148.4
6,315,179 B1 11/2001 Hillis
6,561,402 B2 5/2003 Holland et al.
6,571,997 B2 * 6/2003 Dedrick ..... A45F 5/00 224/183
6,655,560 B2 12/2003 Kahn
6,880,794 B1 4/2005 Kahn
6,892,914 B2 5/2005 Girbert
6,945,440 B1 * 9/2005 Ford ..... B44D 3/12 224/148.6
6,994,328 B2 2/2006 Estabaya
7,047,601 B1 5/2006 Vernon-Woods
7,175,061 B2 2/2007 Dohn
7,489,111 B2 2/2009 Wise
7,784,658 B1 * 8/2010 Hansen ..... A45F 5/02 224/249

(Continued)

*Primary Examiner* — Scott McNurlen
(74) *Attorney, Agent, or Firm* — Haugen Law Firm PLLP

(57) ABSTRACT

A tool holder is described, that is suitable for securely holding a variety of tools within the holder. The tool holder of the invention is particularly well suited for holding a variety of cordless power tools, hammers, squares or other loose tool objects. The apparatus may include a saddle member that partially clamps around the handle of a tool.

13 Claims, 41 Drawing Sheets

(56) References Cited

U.S. PATENT DOCUMENTS

| | | | | |
|---|---|---|---|---|
| 7,968,794 | B1 * | 6/2011 | Baldwin | H02G 3/18 174/66 |
| 8,070,026 | B2 * | 12/2011 | Wadsworth | A45C 11/00 224/197 |
| 8,070,027 | B2 | 12/2011 | Platt, Sr. et al. | |
| 2004/0195280 | A1 * | 10/2004 | Shackelford | A45F 5/00 224/148.7 |
| 2005/0263552 | A1 * | 12/2005 | Panosian | A45F 5/02 224/269 |
| 2007/0095991 | A1 * | 5/2007 | Fall | A45F 5/02 248/229.26 |
| 2011/0259891 | A1 * | 10/2011 | Thibault | B44D 3/14 220/495.06 |
| 2012/0037634 | A1 * | 2/2012 | Kiceniuk, Jr. | B44D 3/121 220/495.02 |

* cited by examiner

TOOL HOLDER

CROSS-REFERENCE TO RELATED APPLICATIONS

This application claims the filing benefit and priority of U.S. Non-Provisional patent application Ser. No. 13/955,850 filed Jul. 31, 2013, and U.S. patent application Ser. No. 29/496,448 filed Jul. 14, 2014, the contents of each of which are incorporated herein by reference in its entirety.

FEDERAL SPONSORSHIP

Not Applicable

JOINT RESEARCH AGREEMENT

Not Applicable

TECHNICAL FIELD

This invention pertains generally to tool holsters. More particularly, the invention pertains to a tool holster having varying configurations to firmly retain a selected tool within the holster or holder. The tool holster of the present invention further reduces sway or slipping of the tool when hung from the waist of a user and maintains the tool slightly away from the user to reduce contact between the tool and the user.

BACKGROUND

Various tasks at construction sites and home improvement projects often demand the use of multiple tools to complete the task. While completing the task it may be desirable to carry or have accessible multiple tools at the same time. For example, a tradesman may wear a tool belt with a pouch to carry pliers, screw drivers, hammers, utility knives, nails, and levels, among other tools necessary to complete a task. Advances in portable battery powered tools have led to the desire to also carry one or more power tools hung from a belt about the waist of the user. A tradesman's pouch, however, is not particularly well suited for carrying bulkier battery powered tools without the risk of the tool falling out of the pouch.

Although belt holsters have been devised in an attempt to allow hands free carrying of an individual tool, the size of the handle, weight of the battery pack and center of mass of the power tool, for example, all affect how well the tool balances in the holster. Further, dimensions of the handle and battery packs vary significantly amongst manufacturers such that many battery powered tools either don't fit in particular holsters or slip around in the holster. Other holsters for other tools similarly may allow the selected tool to slip within the holster. Slipping of the tool in the holster may lead to the tool falling out of the holster or bumping and bruising the user's leg as the tool slips back and forth within the holster. A holster or holder that may retain multiple dimensioned handles of tools in a secure fashion from the waist of a user is desirable.

SUMMARY

Embodiments according to aspects of the invention are capable of supporting a tool firmly hung at the waist of a user. The apparatus includes a backing member or paddle, an extension member, and a tool harness or holder. The backing member rests against the user's hip or upper thigh and includes a curvature that generally conforms to a user's hip or upper thigh. The tool holder includes various configurations adapted to hold firmly various tools, including by way of example, a power tool, hammer, speed square or framer's square. The tool holder may further take the form of a container to receive various loose tools such as nails or screws. The extension member interconnects the backing member and tool holder in a rigid, spaced relation. The spaced relation creates a separation distance between the user's hip or leg and the tool. In this manner a user may walk or otherwise freely moving without having the tool contacting the user's leg. The backing member, extension member, and tool holder member may be constructed as a single, unitary member or may comprise individual members coupled together to form the apparatus of the present invention.

An embodiment according to aspects of the invention includes a backing member, a tool holder and an extension member. The backing member has a front surface, back surface and side surface, wherein the back surface includes a concave curvature. Also, a widest portion of the front surface defines a width of the backing member, a longest portion of the front surface defines a length of the backing member, and a thickest portion of the side surface defines a thickness of the backing member. The tool holder includes an opening to receive a tool. The opening may be sized and shaped dependent upon the tool intended to be retained within the tool holder. Within an interior of the tool holder, the tool holder includes an engaging portion capable of surrounding and contacting a portion of the tool. The extension member interconnects the tool holder and the backing member in a spaced relation. When a tool is retained in the tool holder, the spaced relation between the tool holder and backing member positions the tool away from a user's leg. In this manner, the tool is less likely to rub or hit the user's leg during user movement.

The tool holder may include, without limitation intended, an internal profile portion that is substantially "J" shaped and dimensioned so that a bottom width of the tool holder is less than an outer width of the tool holder measured at a tool retaining end of the tool holder. Further, the backing member may be shaped so that the width of the backing member is greater than or equal to the bottom width of the tool holder. In embodiments of the invention a belt hook may extend from a back portion of the tool holder. The interior engaging portion of the tool holder may include ramp structures projecting upward or inward in a manner that, when engaged with a tool, the ramps may further restrict the ability of the tool to sway. In embodiments of the invention, the tool holder may be shaped in the form of a container that includes a hinged cover to retain loose tools within the container. The cover may include a first set of hinge members extending from a first side of the cover and may also include a second set of hinges extending from a second side of the cover. Additionally, the apparatus may include tabs extending between the backing member and the tool holder, wherein the tabs are capable of restricting flexure of a lower portion of the tool holder towards the backing member.

An embodiment according to aspects of the invention includes a saddle that grips a handle portion of a power tool. In this embodiment of the invention the tool holder includes a tool saddle member, extension, and a backing attachment member. The resilient tool saddle member has a profile portion that is substantially "J" shaped. One end of the J shaped saddle member defines a tool retaining end wherein a bottom width of the saddle member is less than an outer width at the tool retaining end of the saddle member. This configuration allows various handle and tool configurations to firmly rest within the saddle member. The backing attachment member couples to the saddle member and may have a width that is equal to or greater than the bottom width of the saddle member. The width of the backing attachment further provides stability to the saddle member when hung from the belt of a user. The backing member may further include a profile curve to partially surround a hip of a user to further provide stability of the tool hung at the waist of the user. In an embodiment of the invention a distance between the tool retaining end and a straight portion of the saddle is less than a distance of a widest portion of tool saddle member.

Additionally, in embodiments of the invention, the tool saddle member is constructed to clamp at least partially around a tool handle between a trigger and end portion of a handle of the tool. The tool saddle may further include a tool flap and lever arm coupled to the saddle member. Rotational movement of the lever arm actuates the flap between an open and closed position and further retains a tool within the saddle. An end of the tool flap may clip under an inner rib of the J shaped saddle member to additionally secure the tool within the saddle.

In an embodiment of the invention the tool holder apparatus includes a resilient tool saddle member that has a substantially straight longitudinal segment and a curved segment extending from an end of the longitudinal segment. The curved segment has a tool retaining end segment wherein a diameter of the curved segment is greater than a distance between the tool retaining end segment and the longitudinal segment. At least a portion of the curved segment has a width that is less than a width of the longitudinal segment. An inner rib extends from a tool retaining end segment towards the longitudinal segment, wherein the inner rib further reduces the distance between the tool retaining end segment and the longitudinal segment. A tool flap and lever arm couple to the saddle member in a manner so that the lever arm actuates the flap between an open and closed position. An end of the tool flap clips under the inner rib.

The tool saddle member may clamp at least partially around a tool handle between a trigger and end portion of a handle of the tool, wherein an outer width at the tool retaining end segment approximates a length of the tool handle. Embodiments of the invention includes the tool retaining end segment having one or more outer ribs extending outward from the retaining end segment. The outer ribs may be utilized as a thumb hold to ply the tool retaining segment open and away from the tool handle as the user removes the tool from the tool saddle member.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
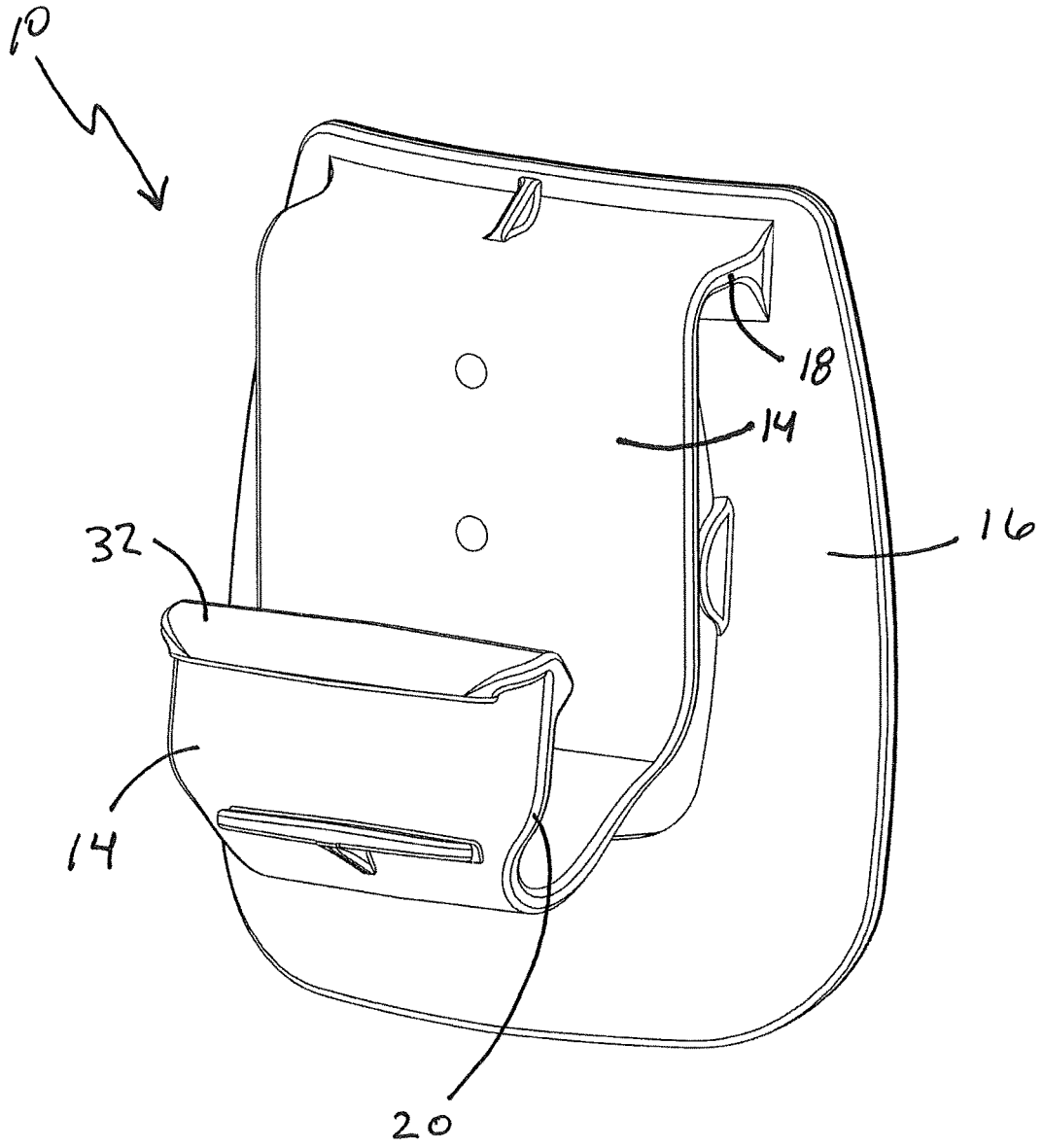
FIG. 1 is a front perspective view of an embodiment of a tool saddle holder of the tool holder of the present invention.
Figure 2:
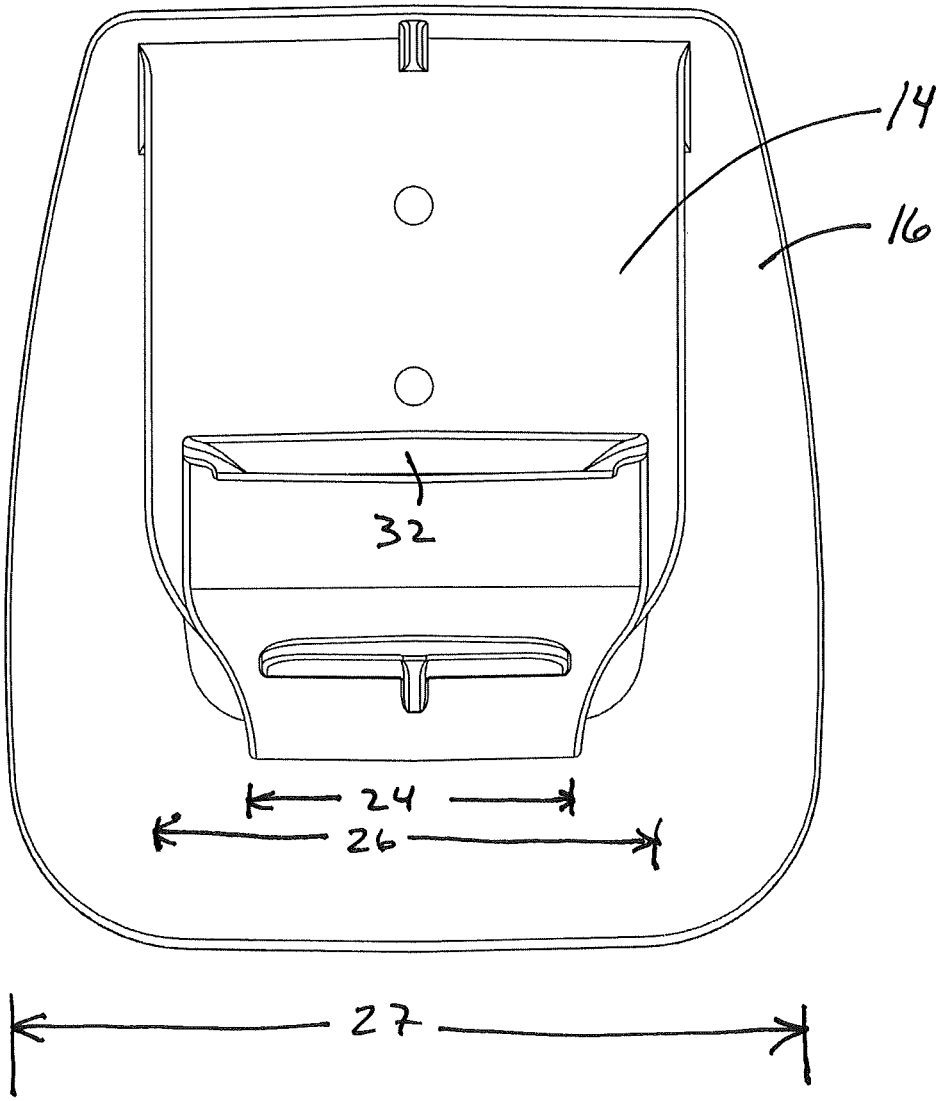
FIG. 2 is a front view of the tool saddle holder of the invention of the type shown in FIG. 1.
Figure 3:
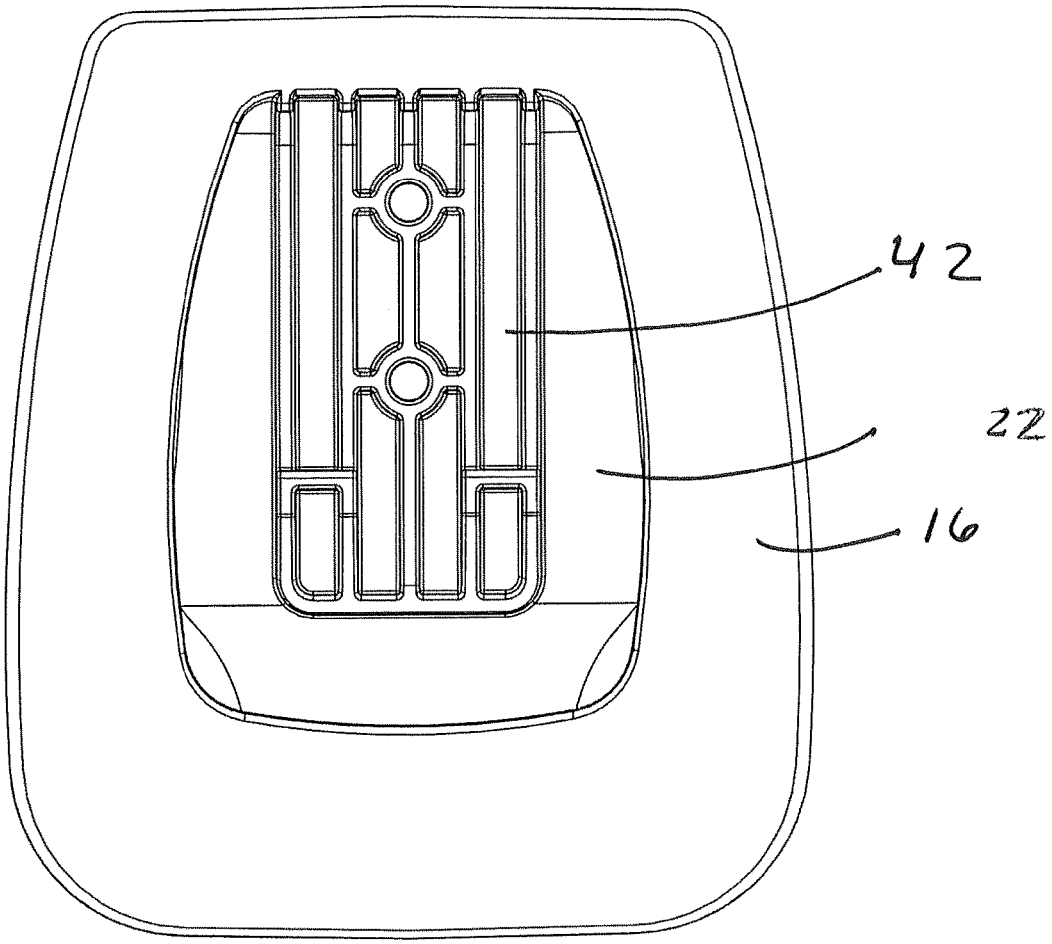
FIG. 3 is a back view of an embodiment of a tool saddle holder of the invention.
Figure 4:
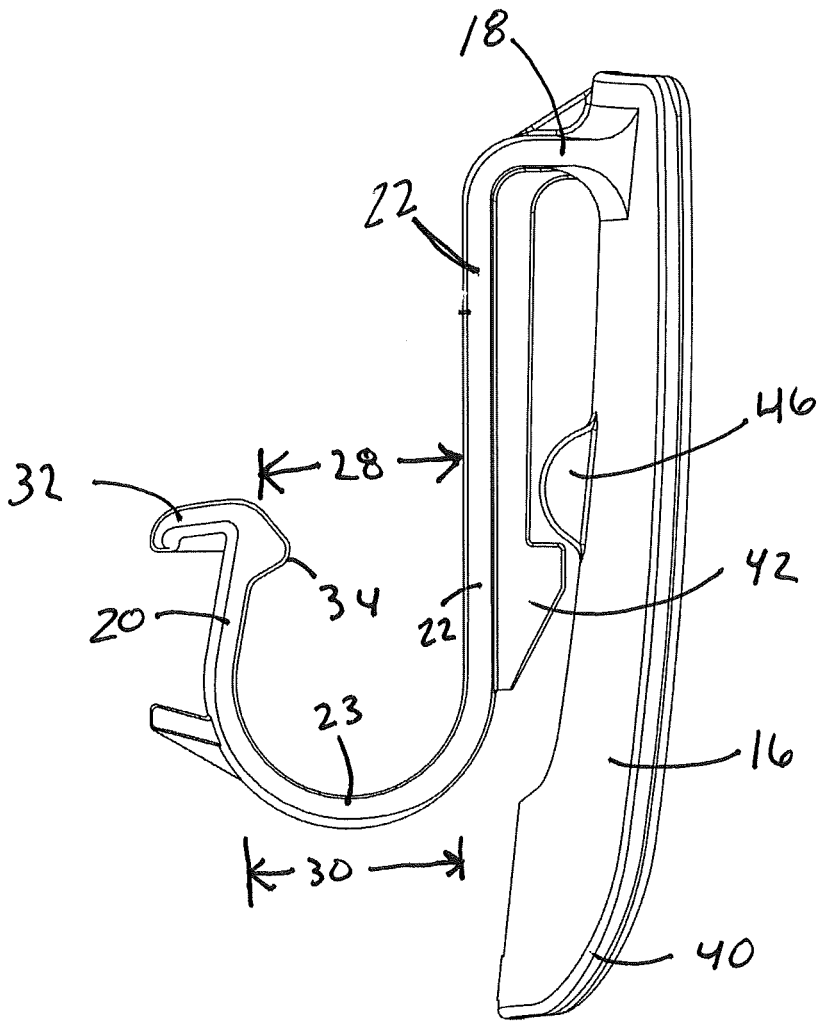
FIG. 4 is a side perspective view of an embodiment of a tool saddle holder of the invention.
Figure 5:
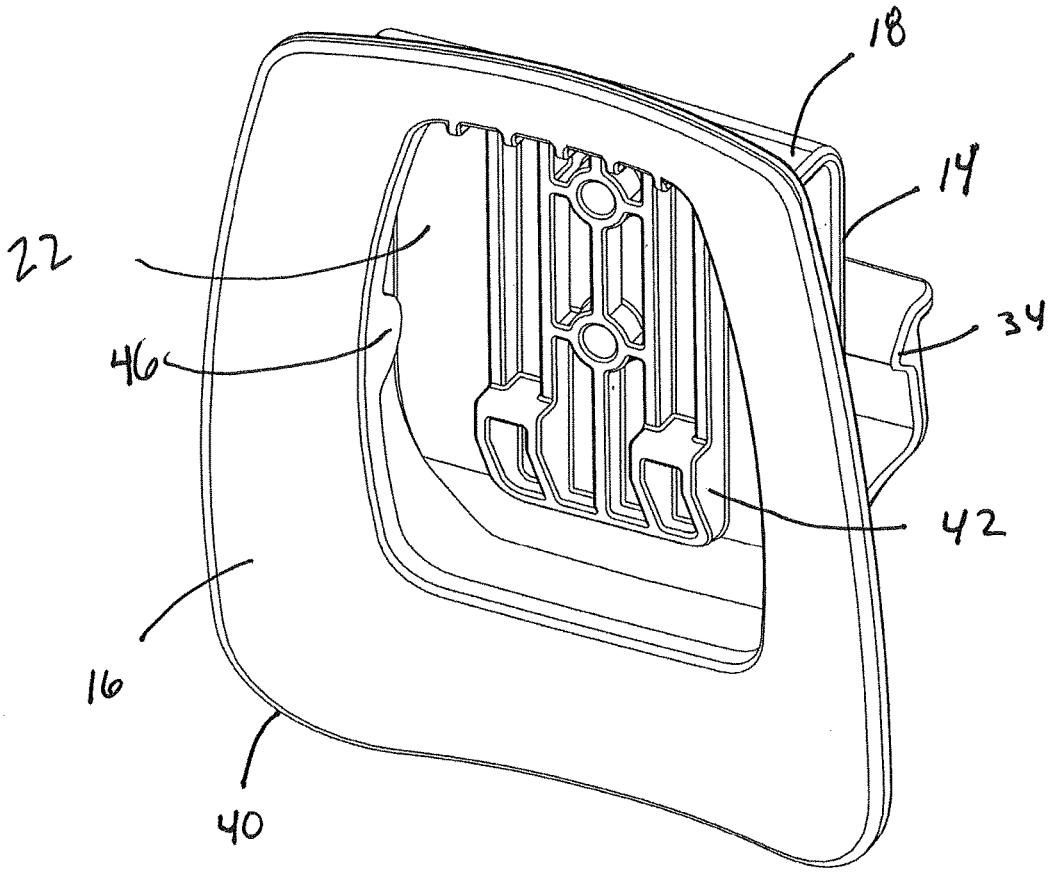
FIG. 5 is a back perspective view of an embodiment of a tool saddle holder of the present invention.
Figure 6:
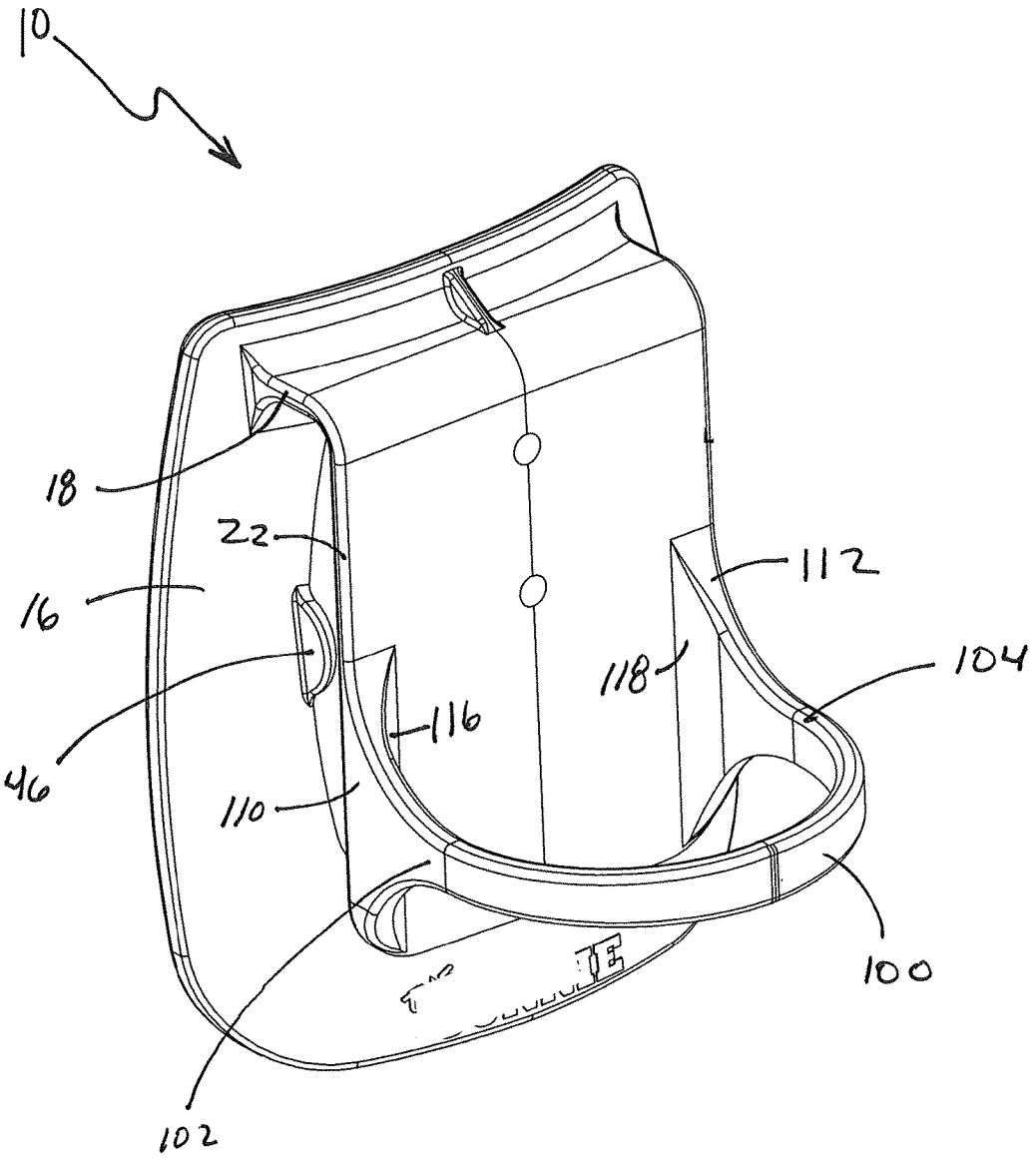
FIG. 6 is a front perspective view of an embodiment of a tool tack holder of the tool holder of the present invention.
Figure 7:
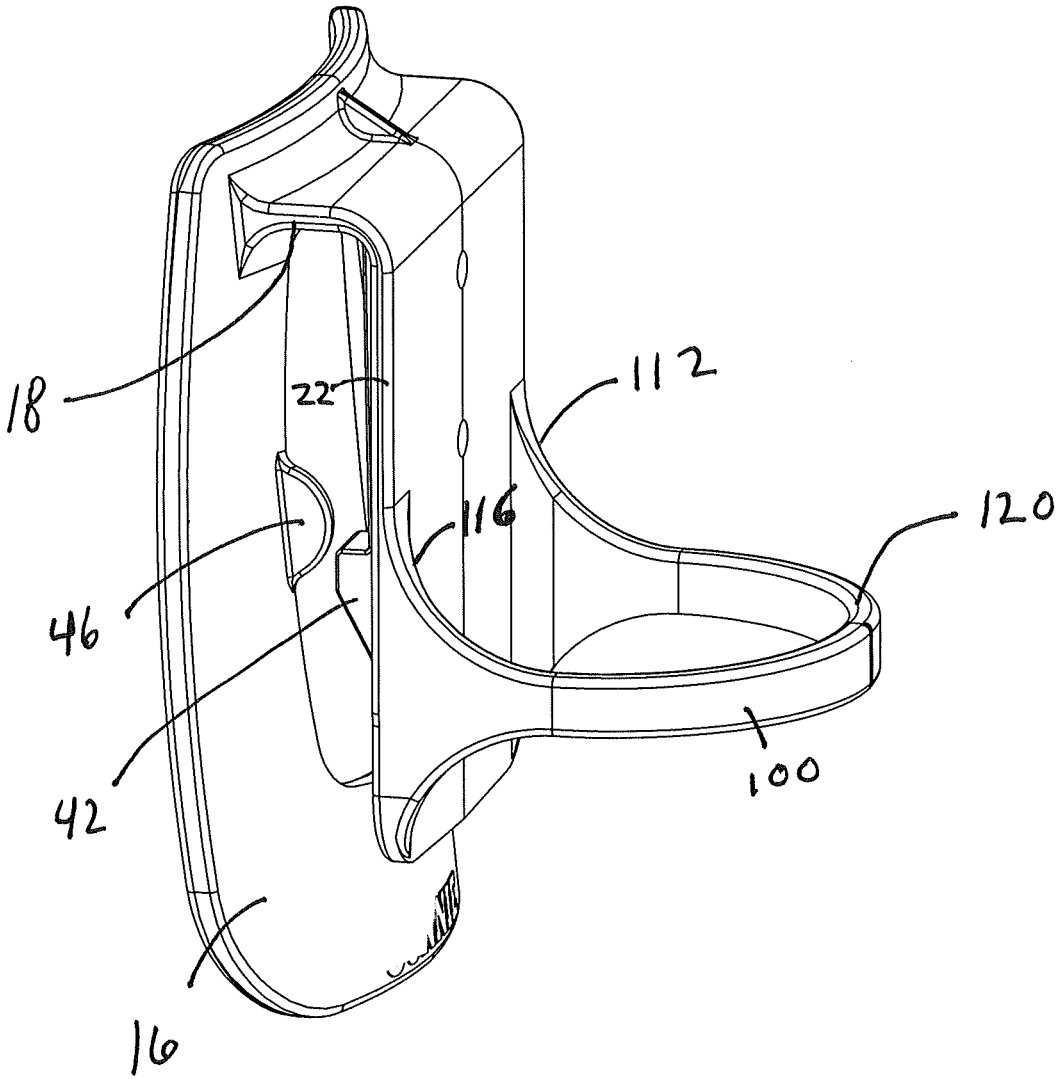
FIG. 7 is a side perspective view of the tool tack holder of the type shown in FIG. 6.
Figure 8:
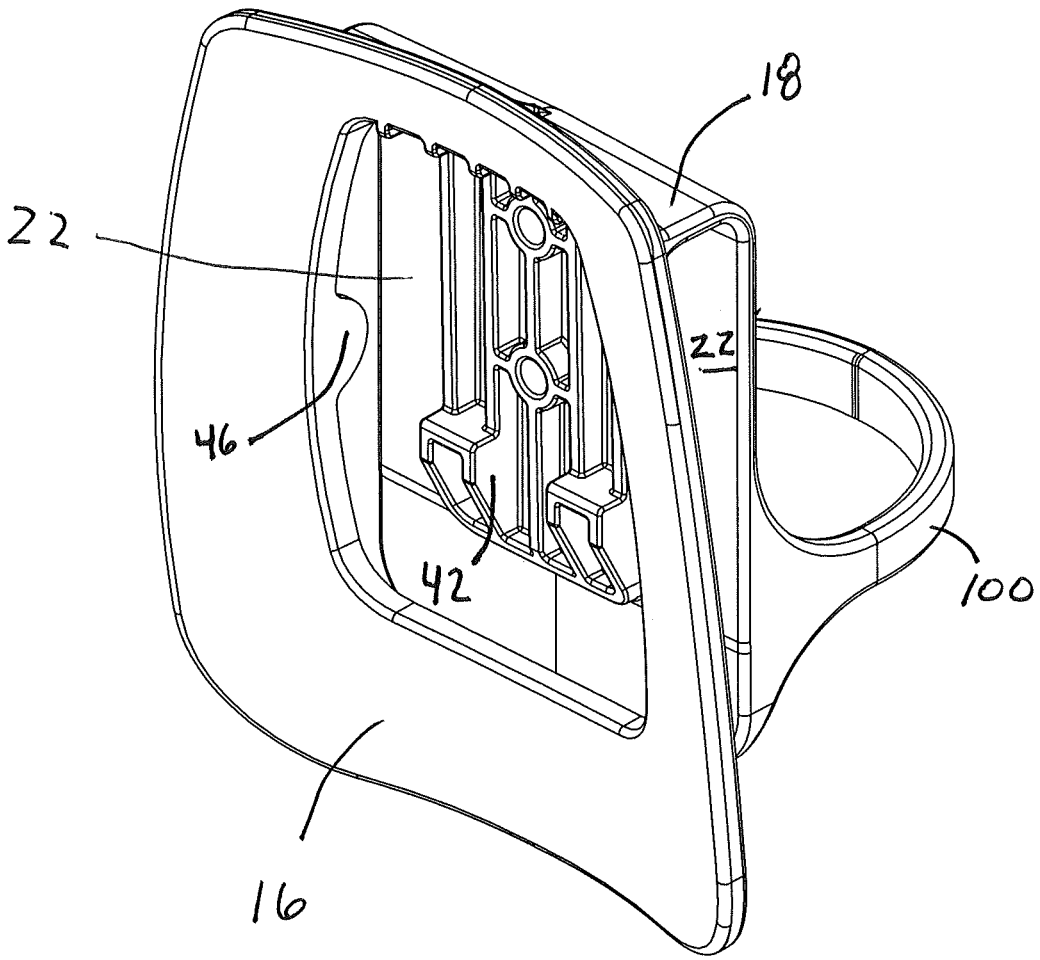
FIG. 8 is a back perspective view of an embodiment of a tool tack holder of the present invention.
Figure 9:
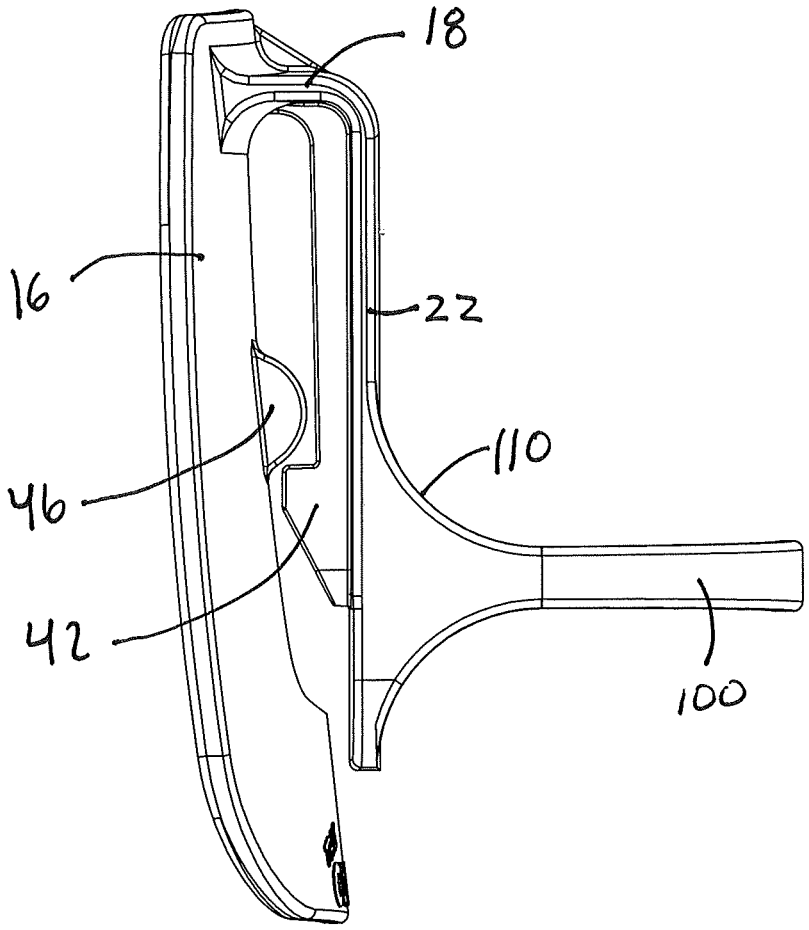
FIG. 9 is a side perspective view of an embodiment of a tool tack holder of the present invention.
Figure 10:
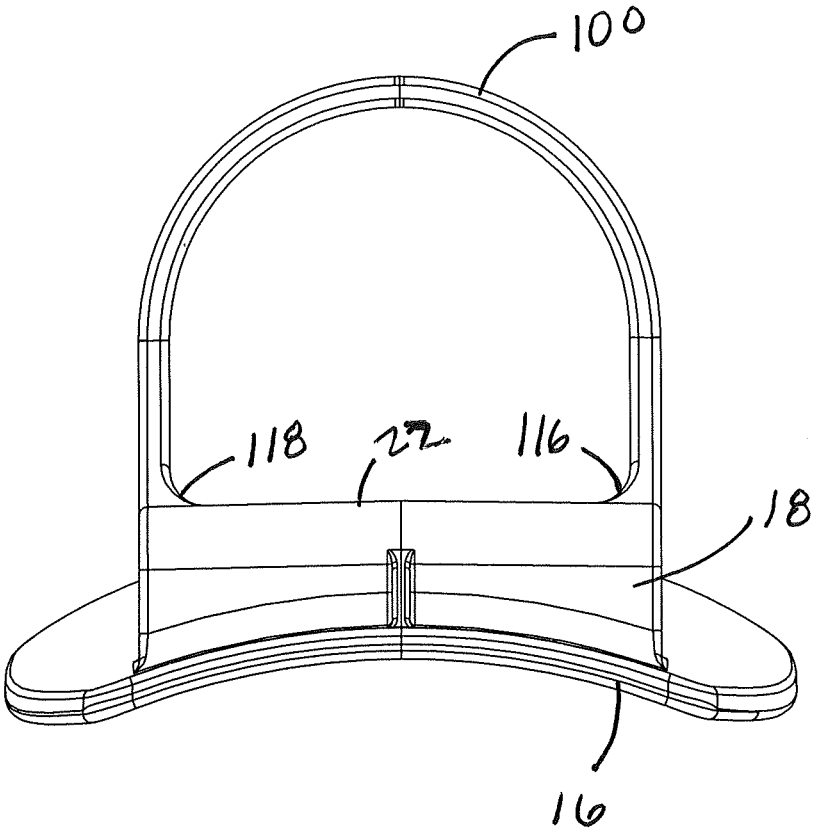
FIG. 10 is a top perspective view of the tool tack holder of the type shown in FIG. 6.
Figure 11:
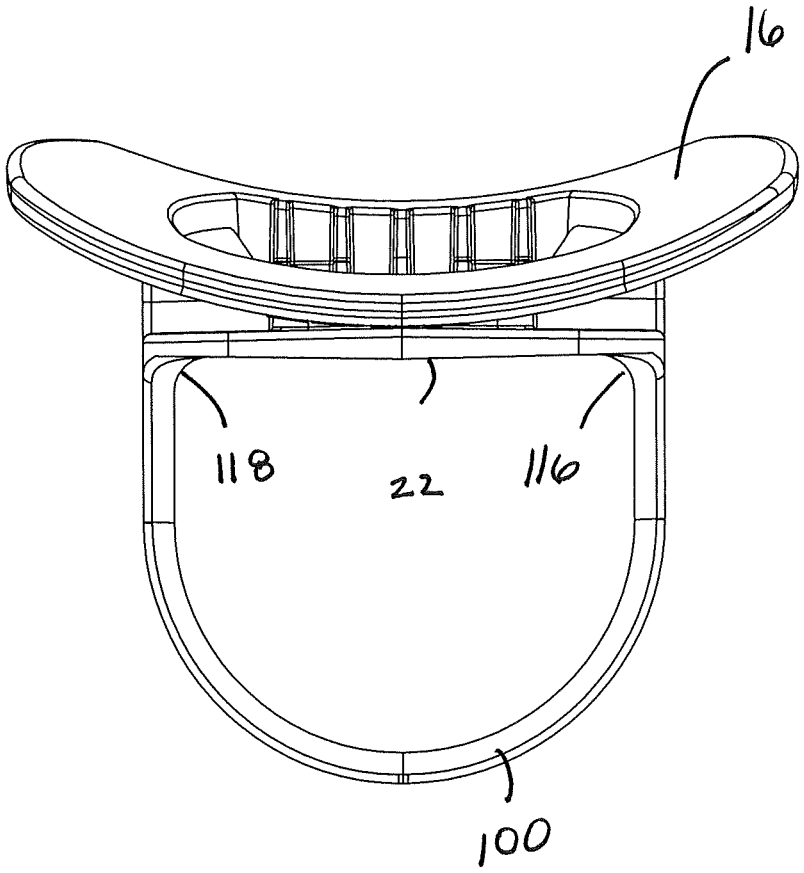
FIG. 11 is a bottom perspective view of the tool tack holder of the type shown in FIG. 6.
Figure 12:
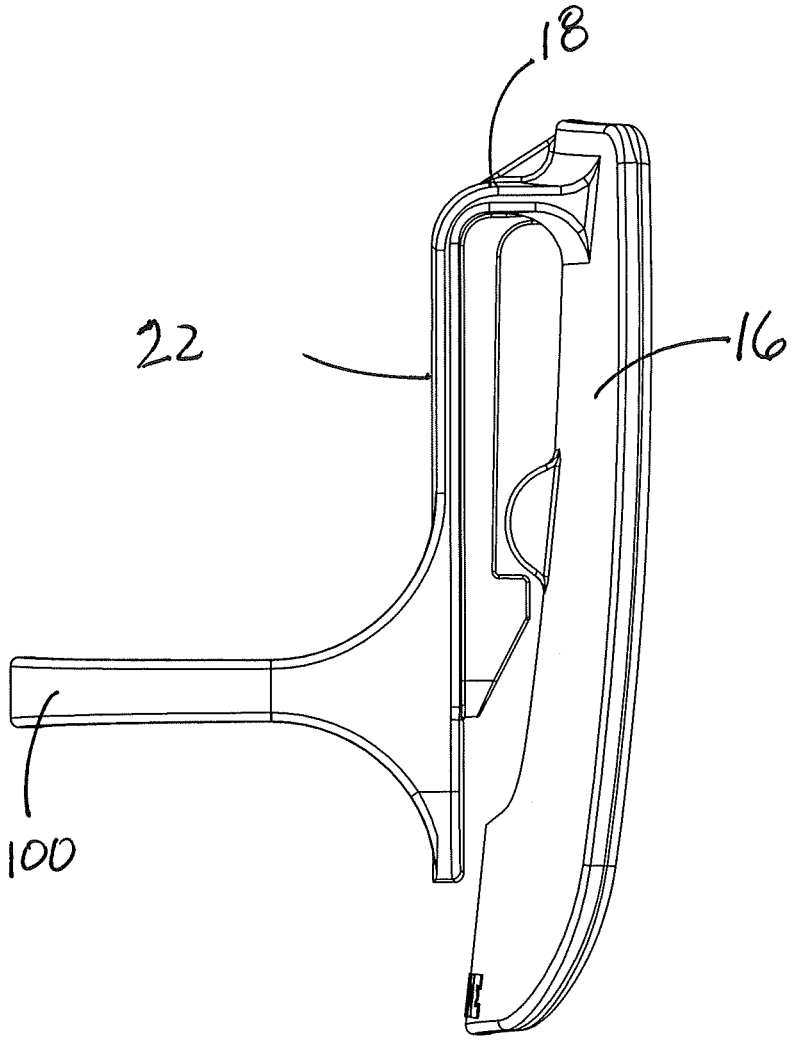
FIG. 12 is an opposing side perspective view of the tool tack holder of the type shown in FIG. 10.
Figure 13:
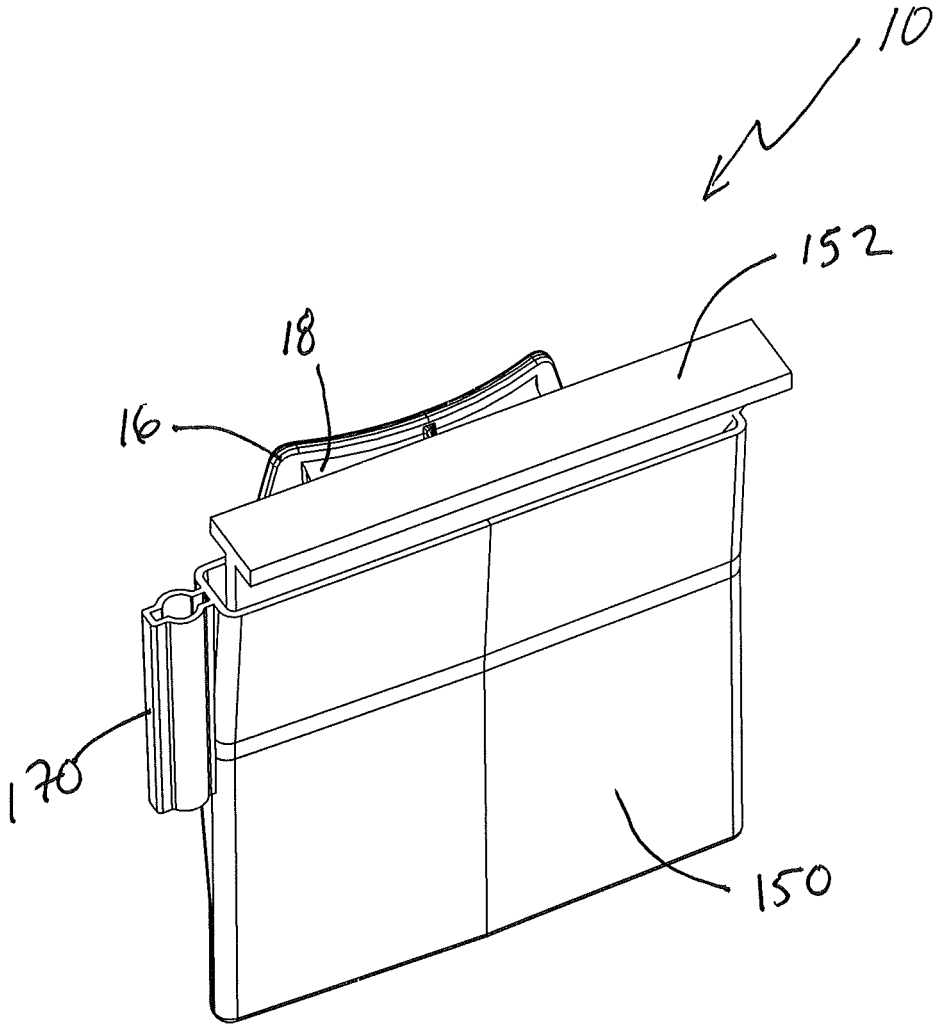
FIG. 13 is a front perspective view of an embodiment of a tool square holder of the tool holder of the present invention showing a speed square inserted in the holder.
Figure 14:
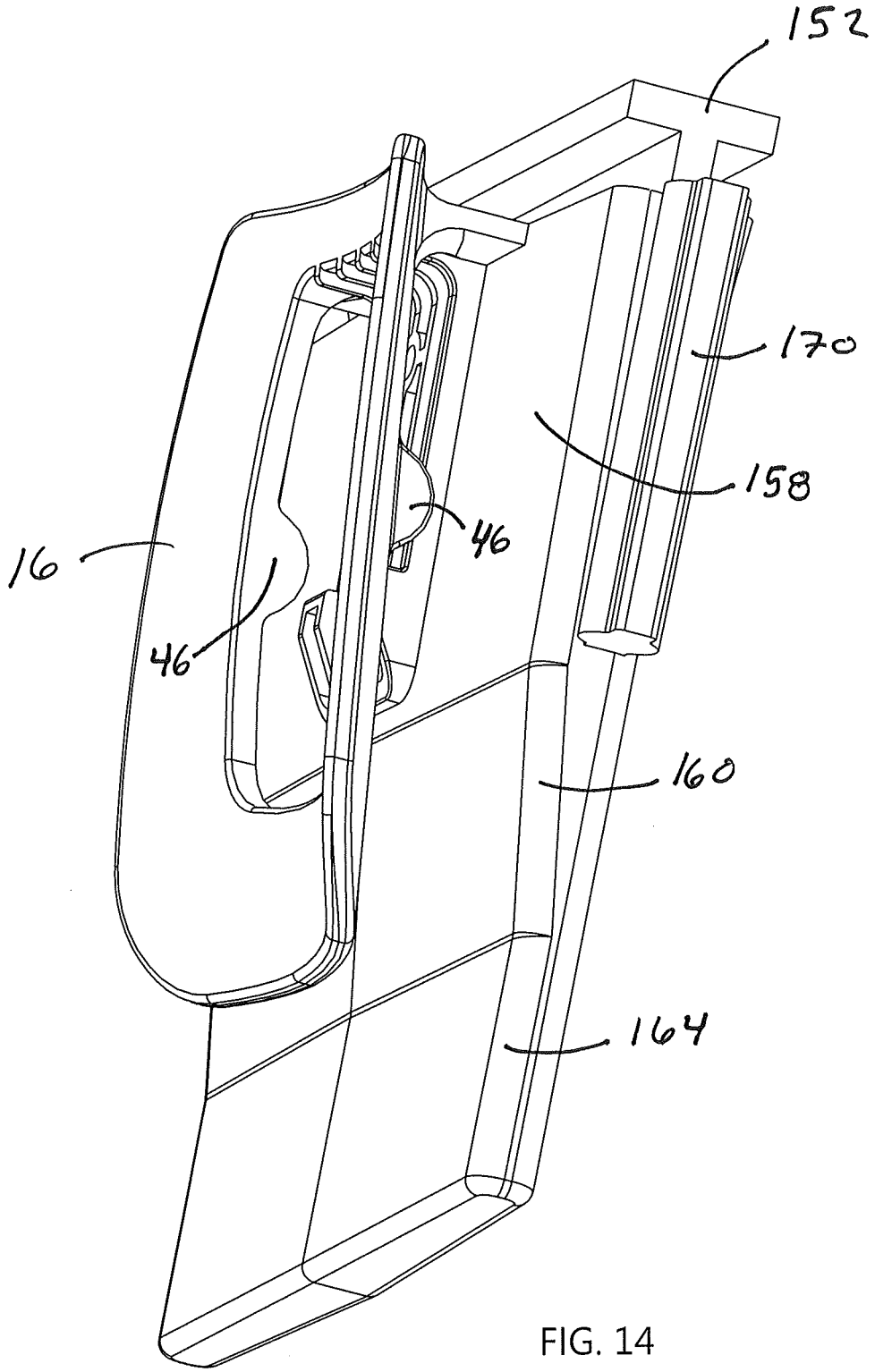
FIG. 14 is a bottom back perspective view of an embodiment of a tool square holder of the tool holder of the present invention showing a speed square inserted in the holder.
Figure 15:
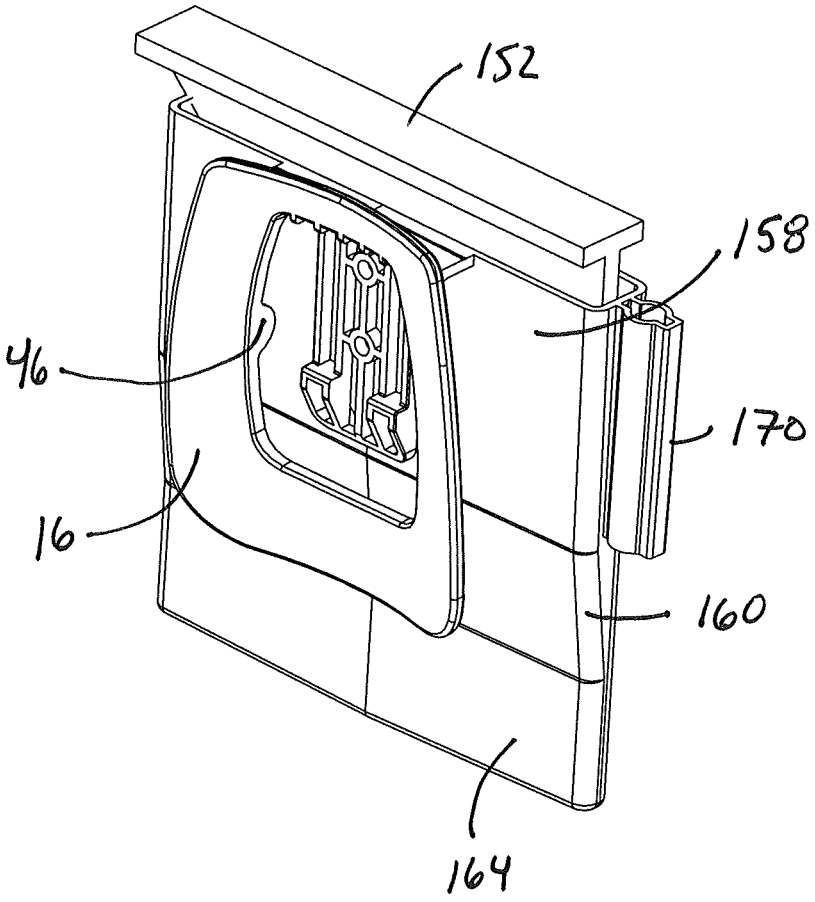
FIG. 15 is a back perspective view of an embodiment of a tool square holder of the tool holder of the present invention showing a speed square inserted in the holder.
Figure 16:
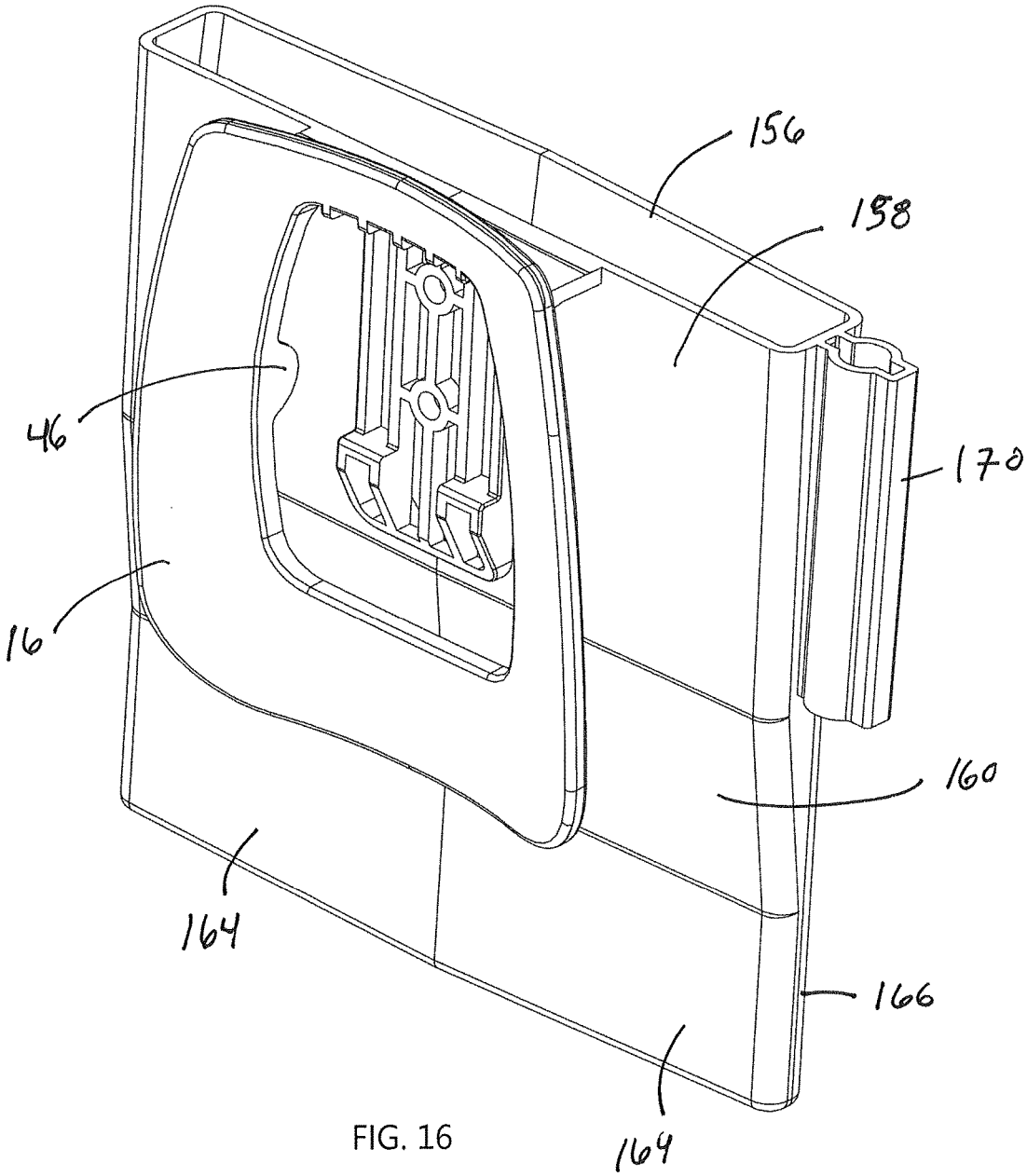
FIG. 16 is a back perspective view of an embodiment of a tool square holder of the tool holder of the present invention.
Figure 17:
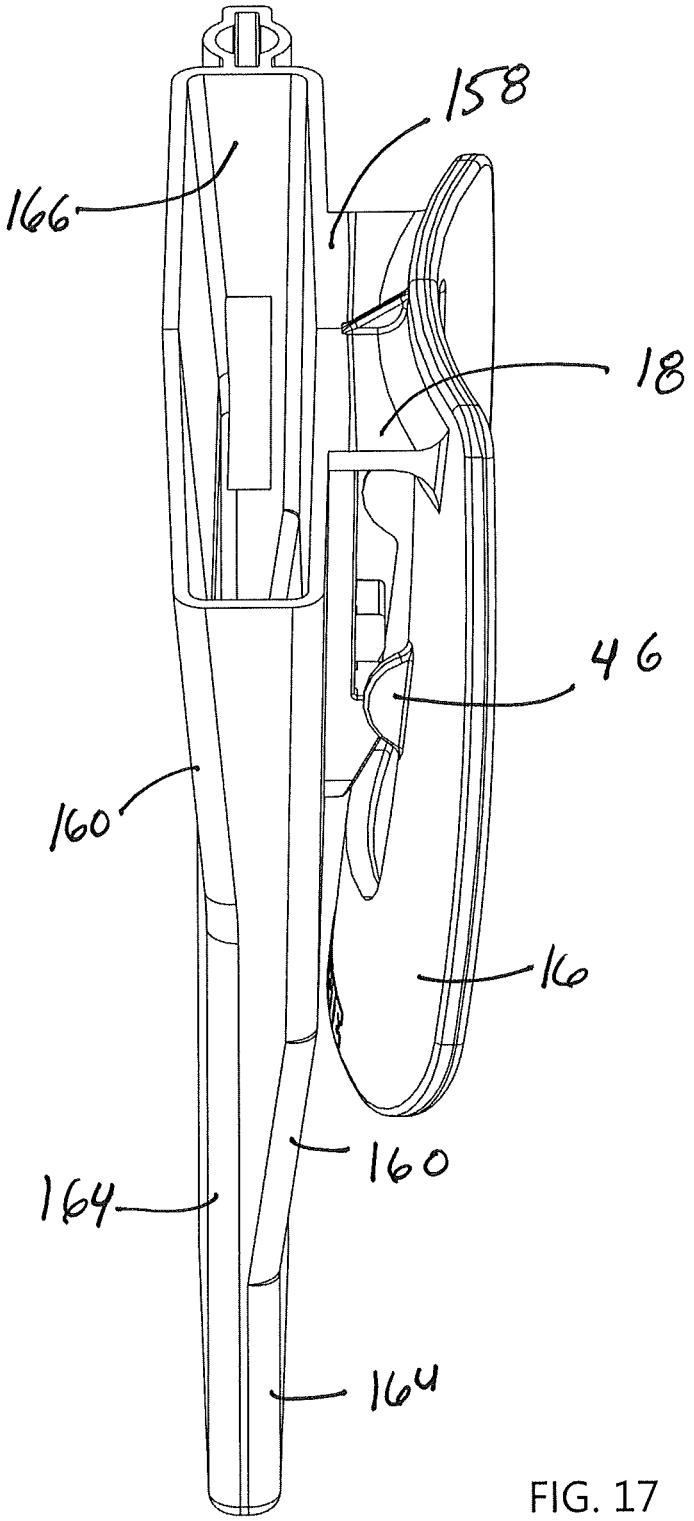
FIG. 17 is a top front perspective view of an embodiment of a tool square holder of the tool holder of the present invention.
Figure 18:
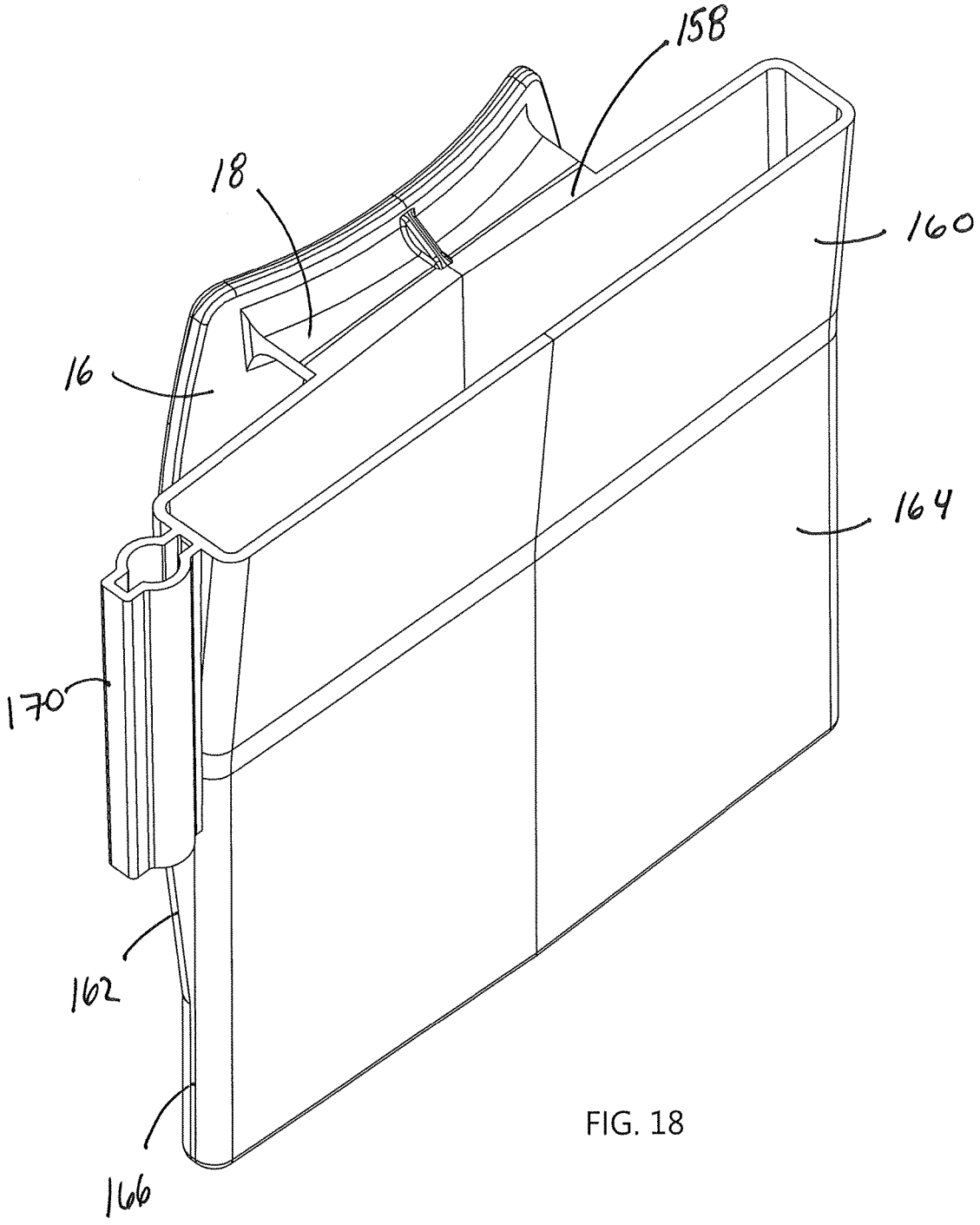
FIG. 18 is a top side perspective view of the tool square holder of the type shown in FIG. 17.
Figure 19:
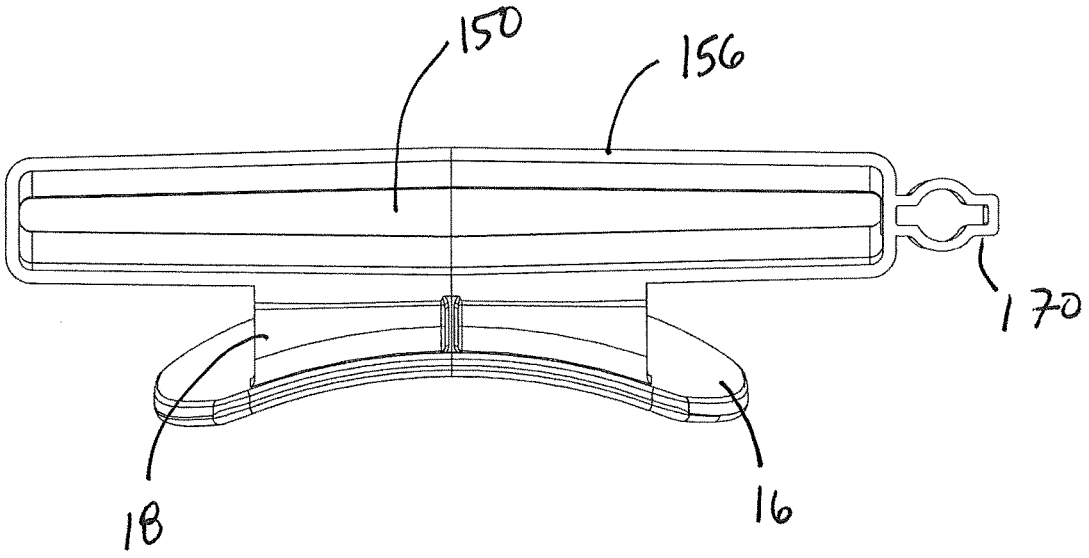
FIG. 19 is a top perspective view of the tool square holder of the type shown in FIG. 17.
Figure 20:
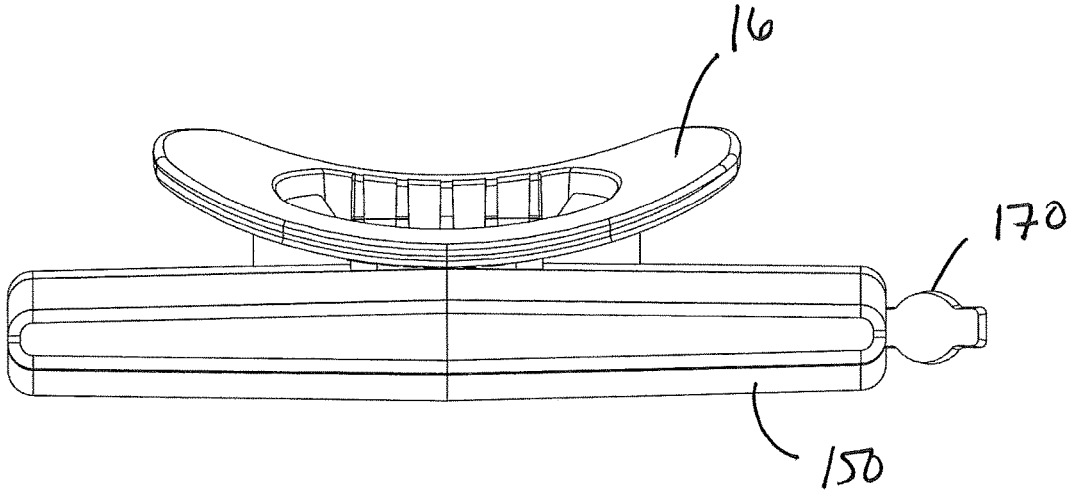
FIG. 20 is a bottom perspective view of the tool square holder of the type shown in FIG. 17.
Figure 21:
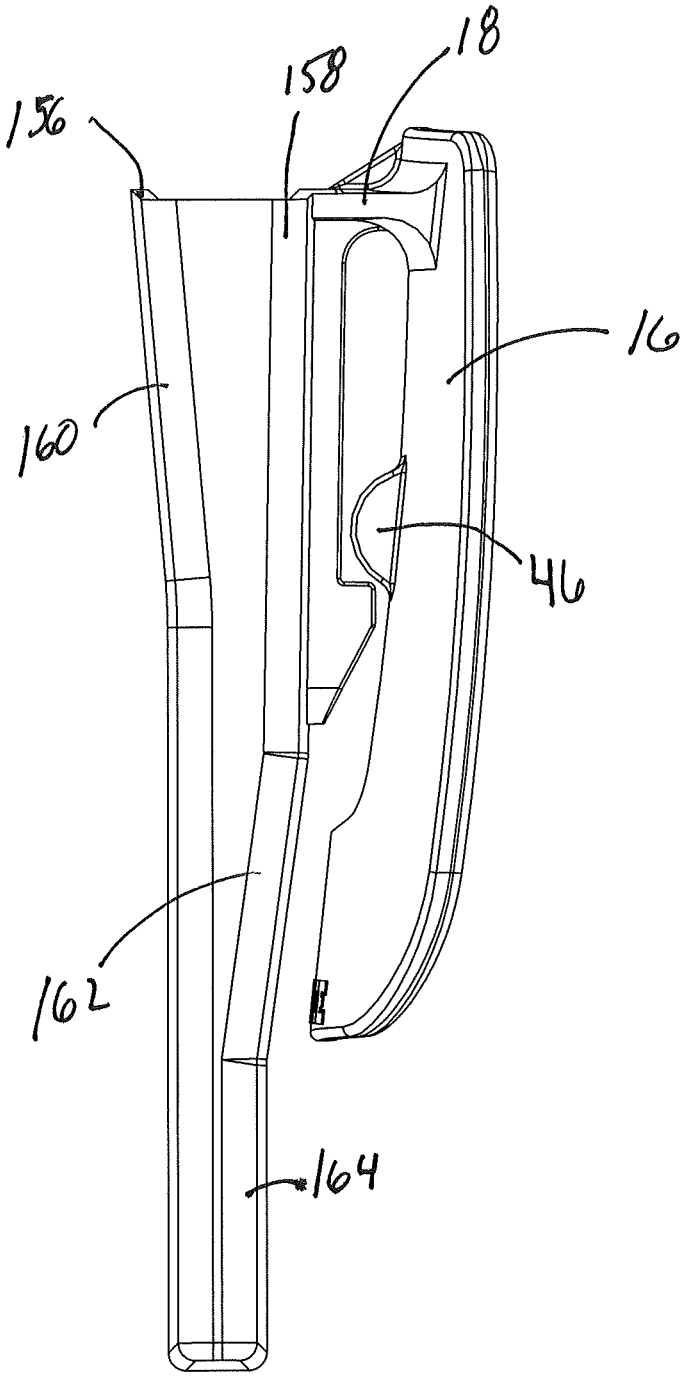
FIG. 21 is a right perspective view of the tool square holder of the type shown in FIG. 17.
Figure 22:
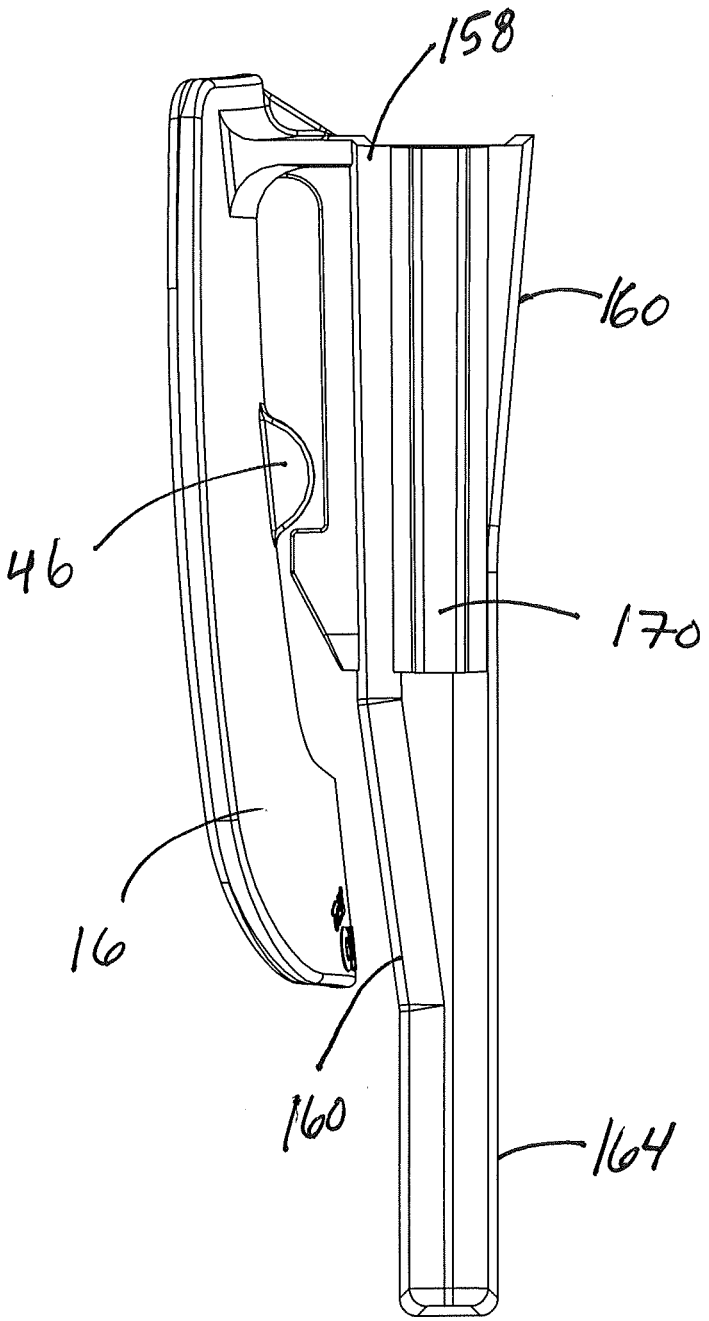
FIG. 22 is a left perspective view of the tool square holder of the type shown in FIG. 17.
Figure 23:
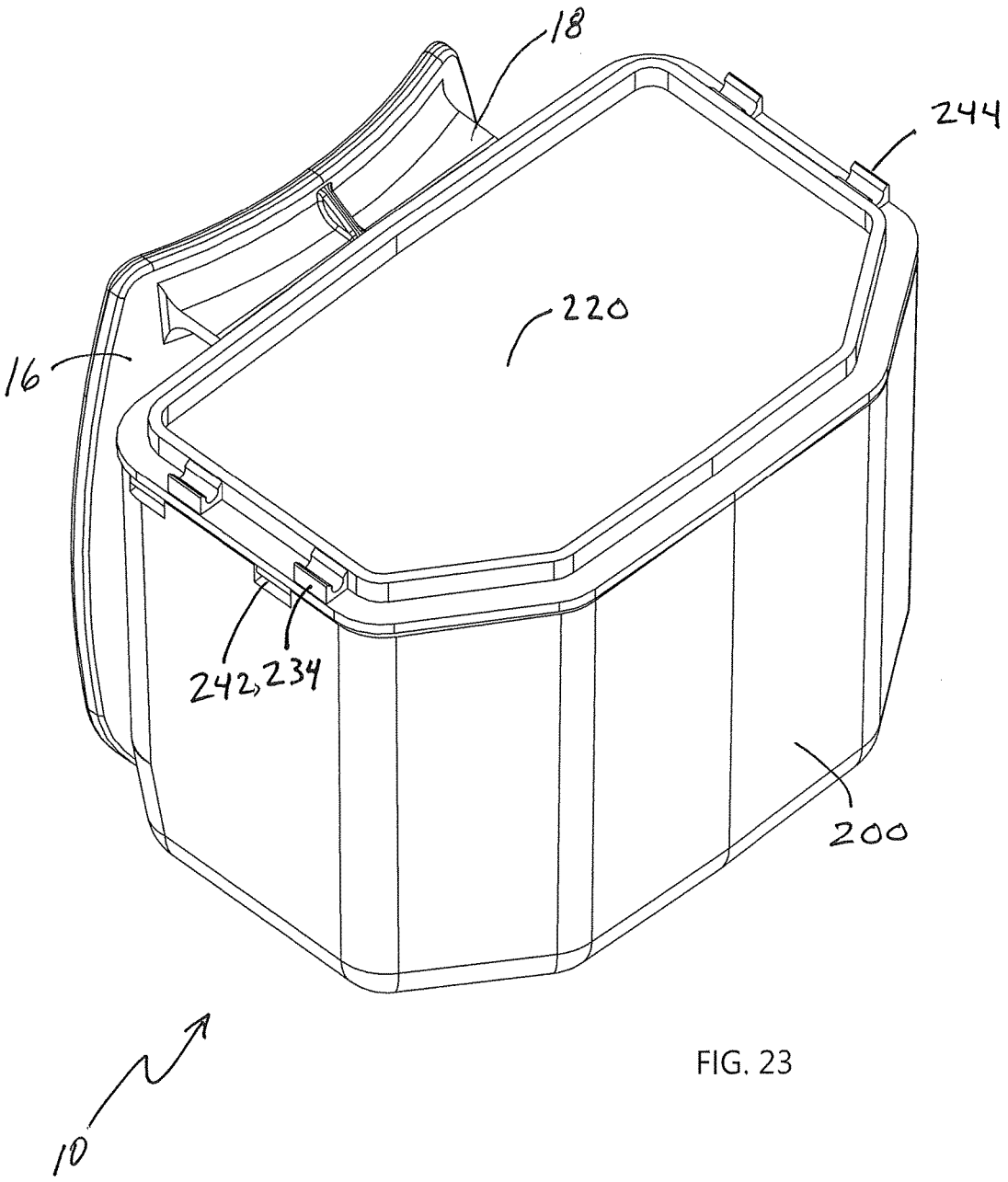
FIG. 23 is a top front perspective view of an embodiment of a tool sack holder of the tool holder of the present invention showing a closed lid.
Figure 24:
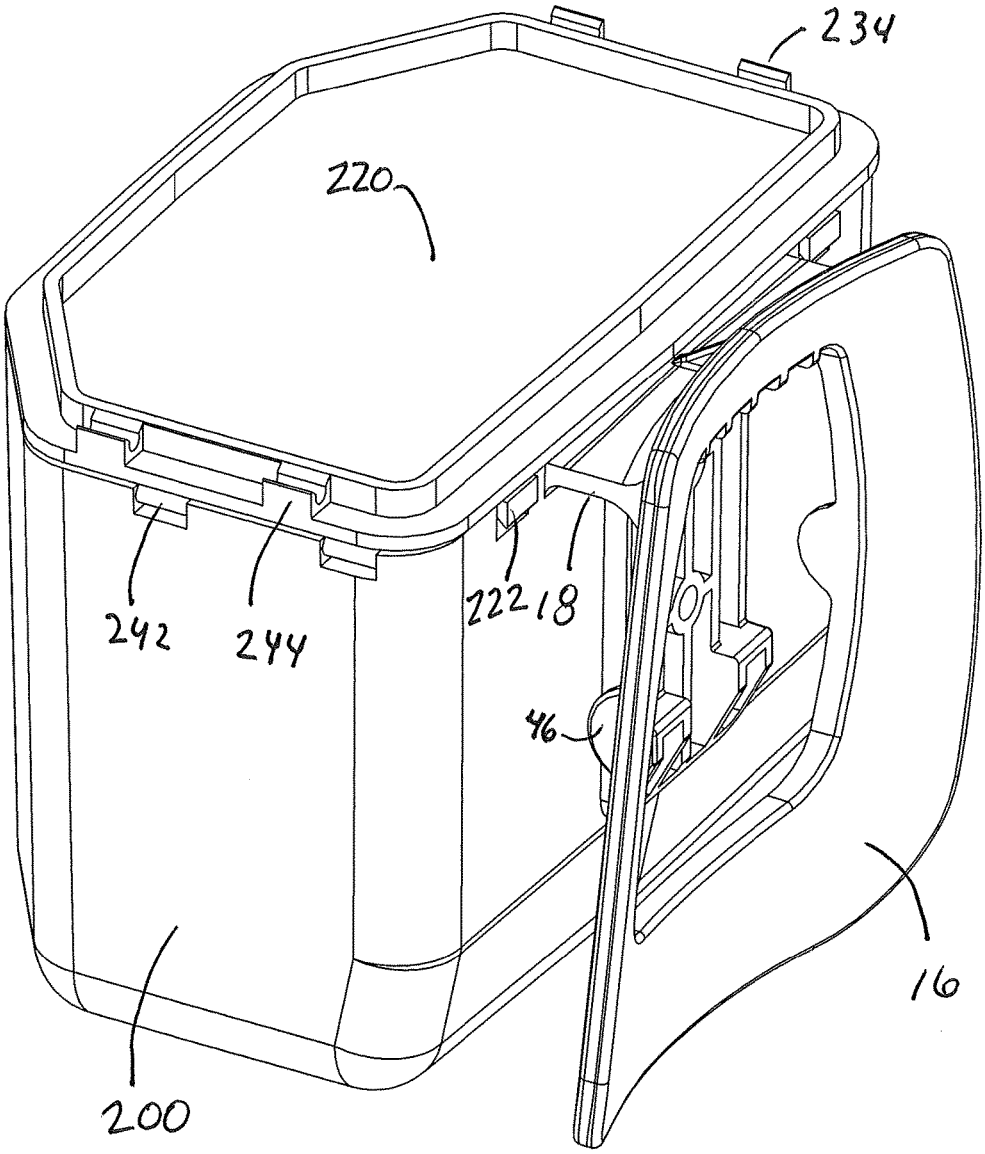
FIG. 24 is a top back left perspective view of the tool sack holder of the type show in FIG. 23.
Figure 25:
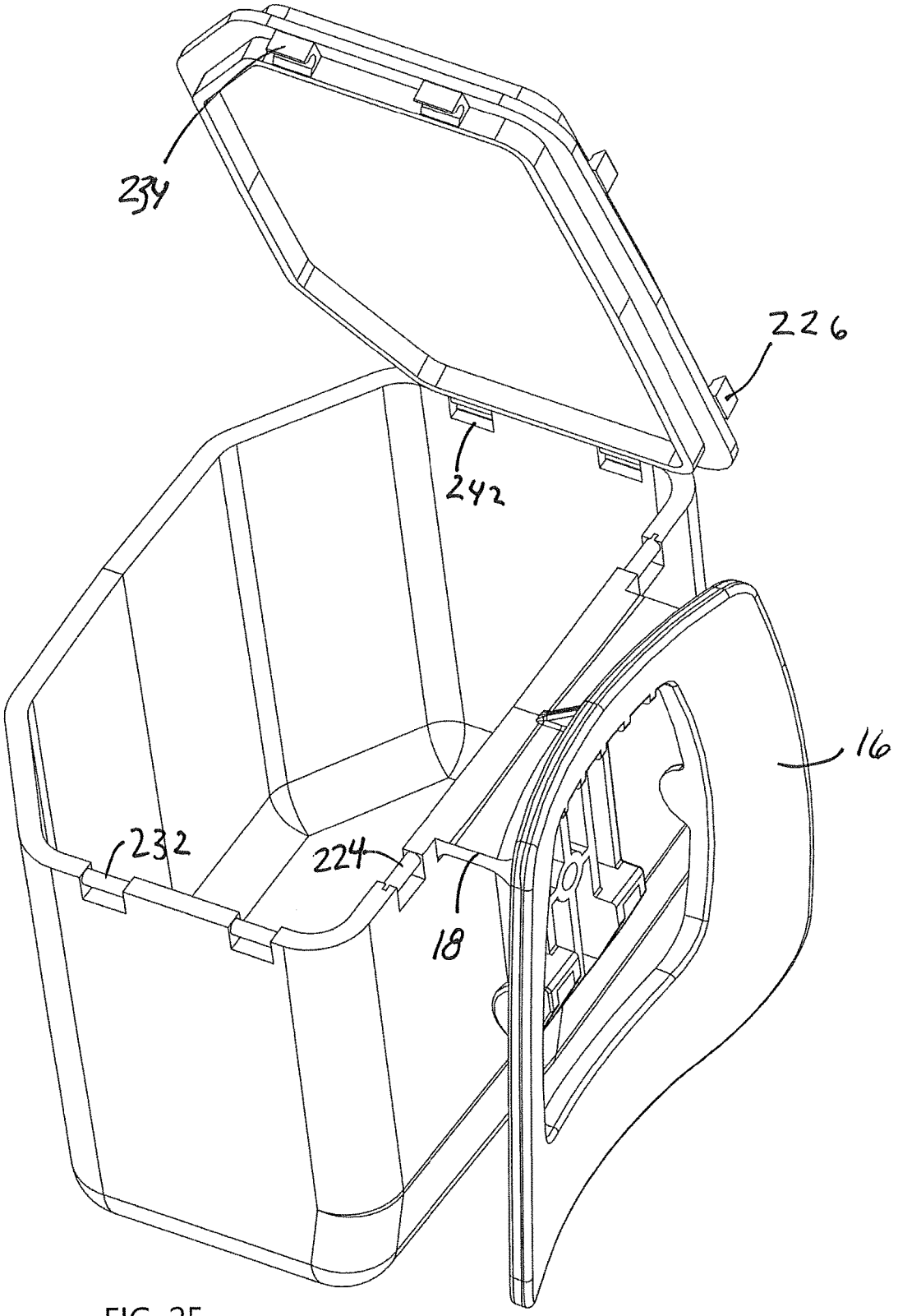
FIG. 25 is a top back perspective view of an embodiment of a tool sack holder of the tool holder of the present invention showing an open lid.
Figure 26:
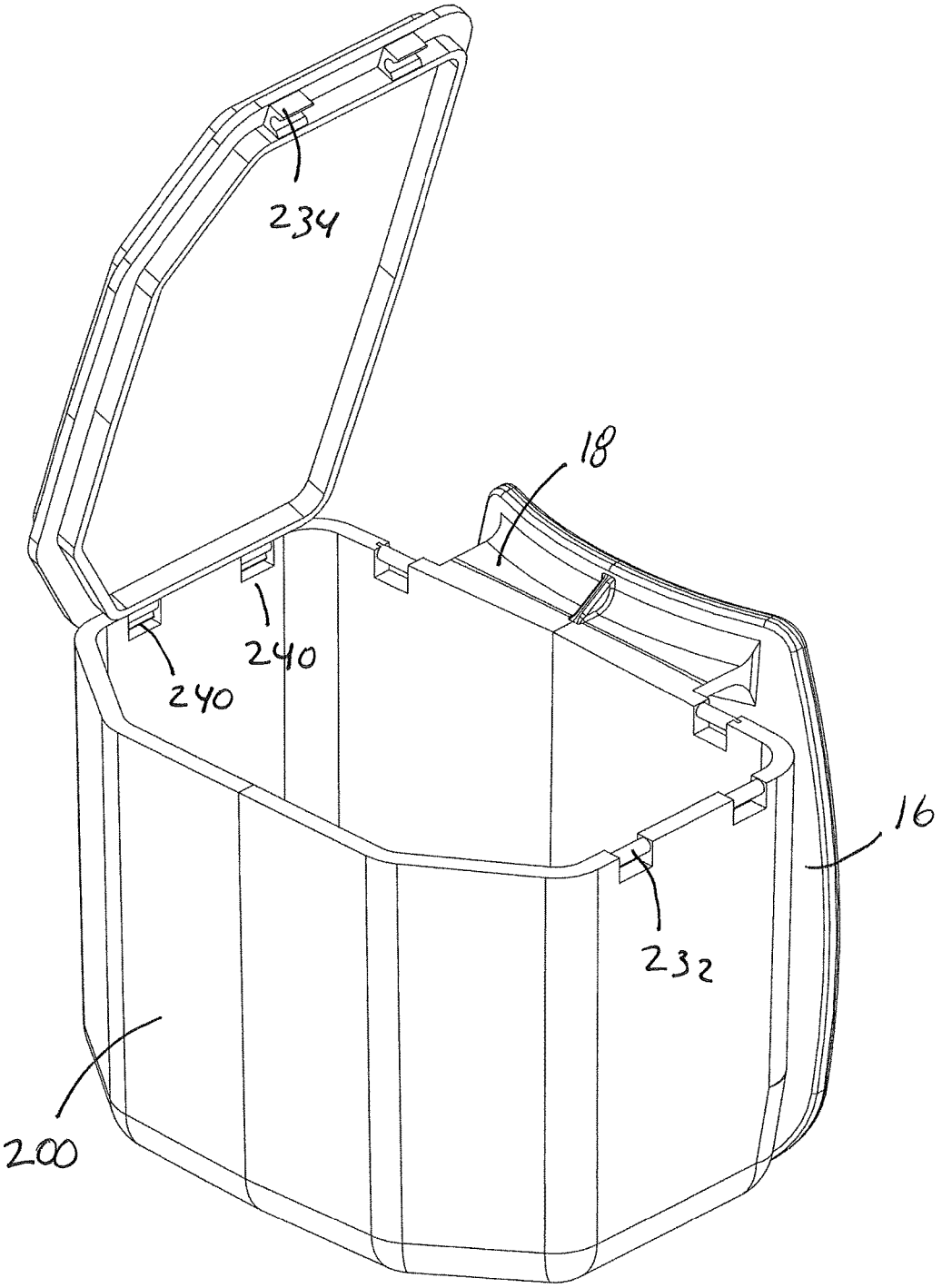
FIG. 26 is a bottom front perspective view of an embodiment of a tool sack holder of the tool holder of the present invention showing an open lid.
Figure 27:
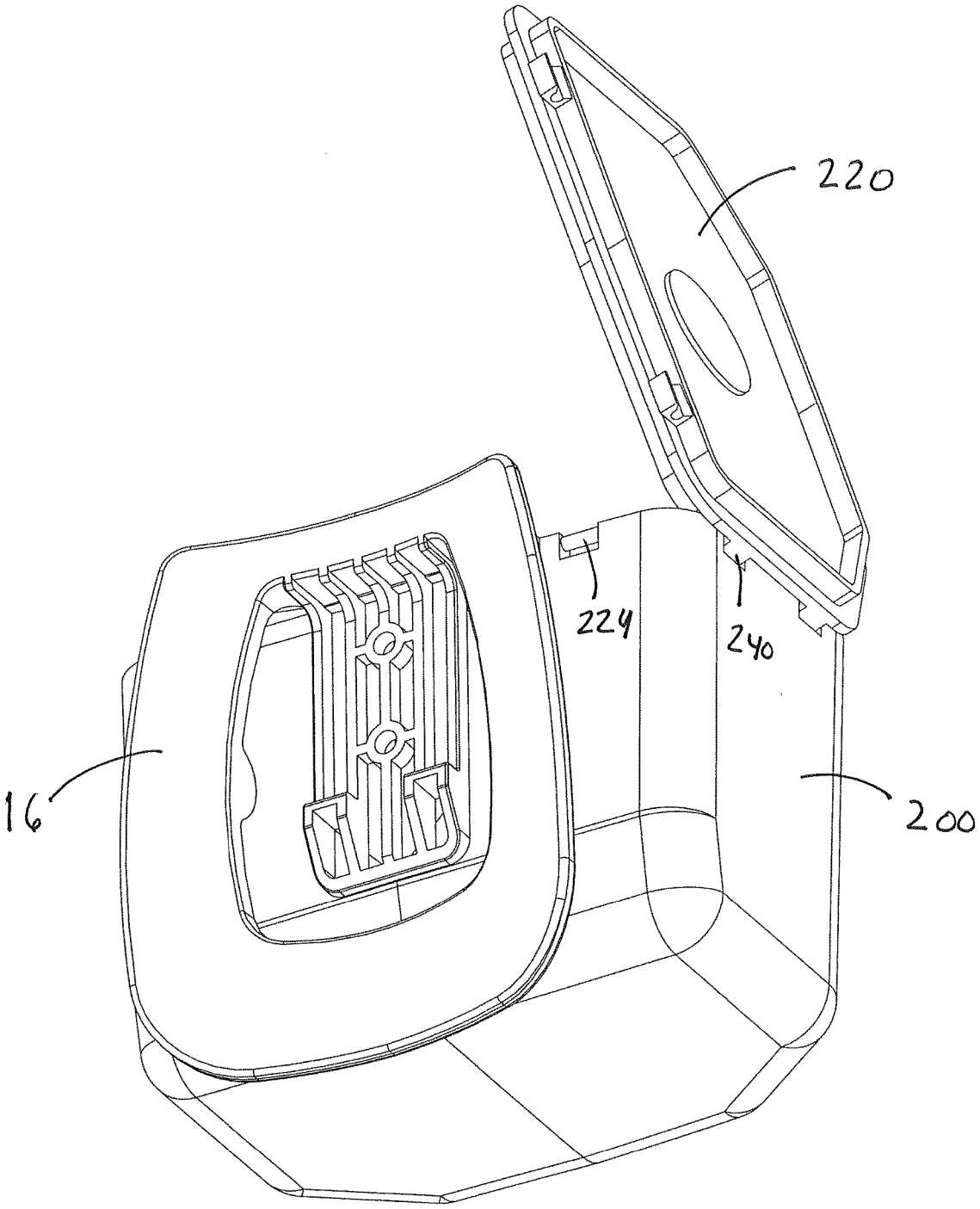
FIG. 27 is a front right perspective view of an embodiment of a tool sack holder of the tool holder of the present invention showing an open lid.
Figure 28:
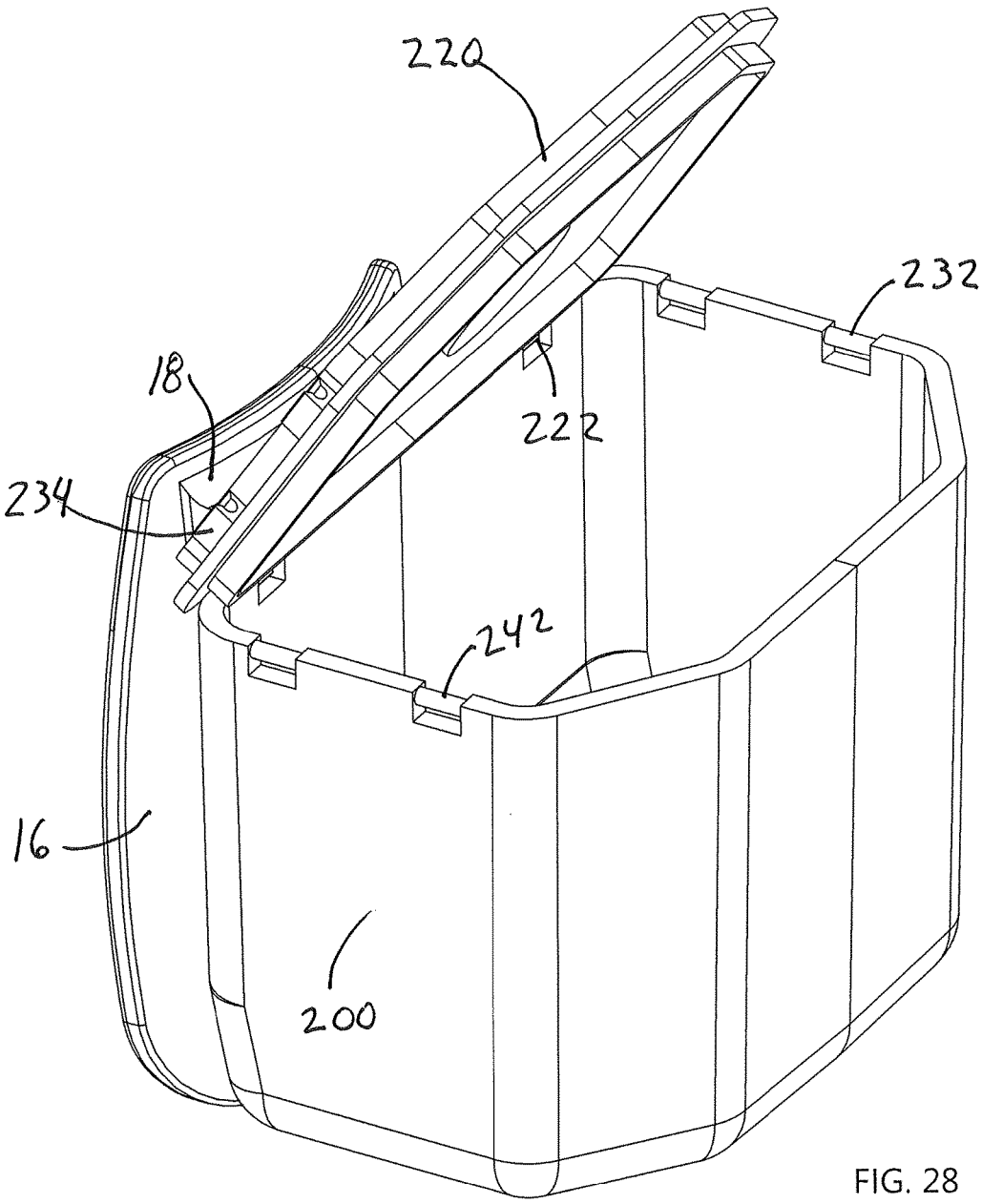
FIG. 28 is a top front left perspective view of an embodiment of a tool sack holder of the tool holder of the present invention showing an open lid.
Figure 29:
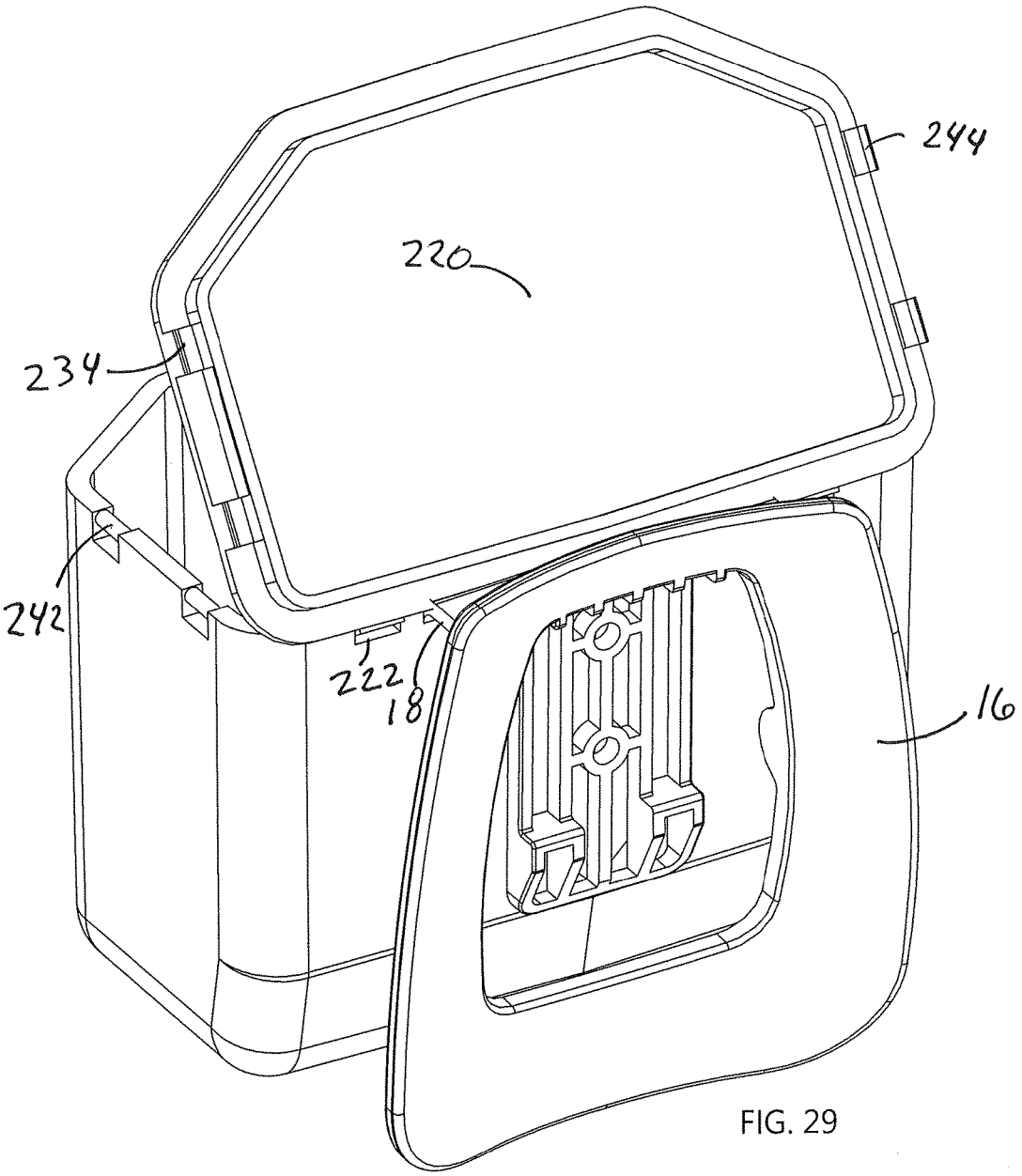
FIG. 29 is a bottom right back perspective view of an embodiment of a tool sack holder of the tool holder of the present invention showing an open lid.
Figure 30:
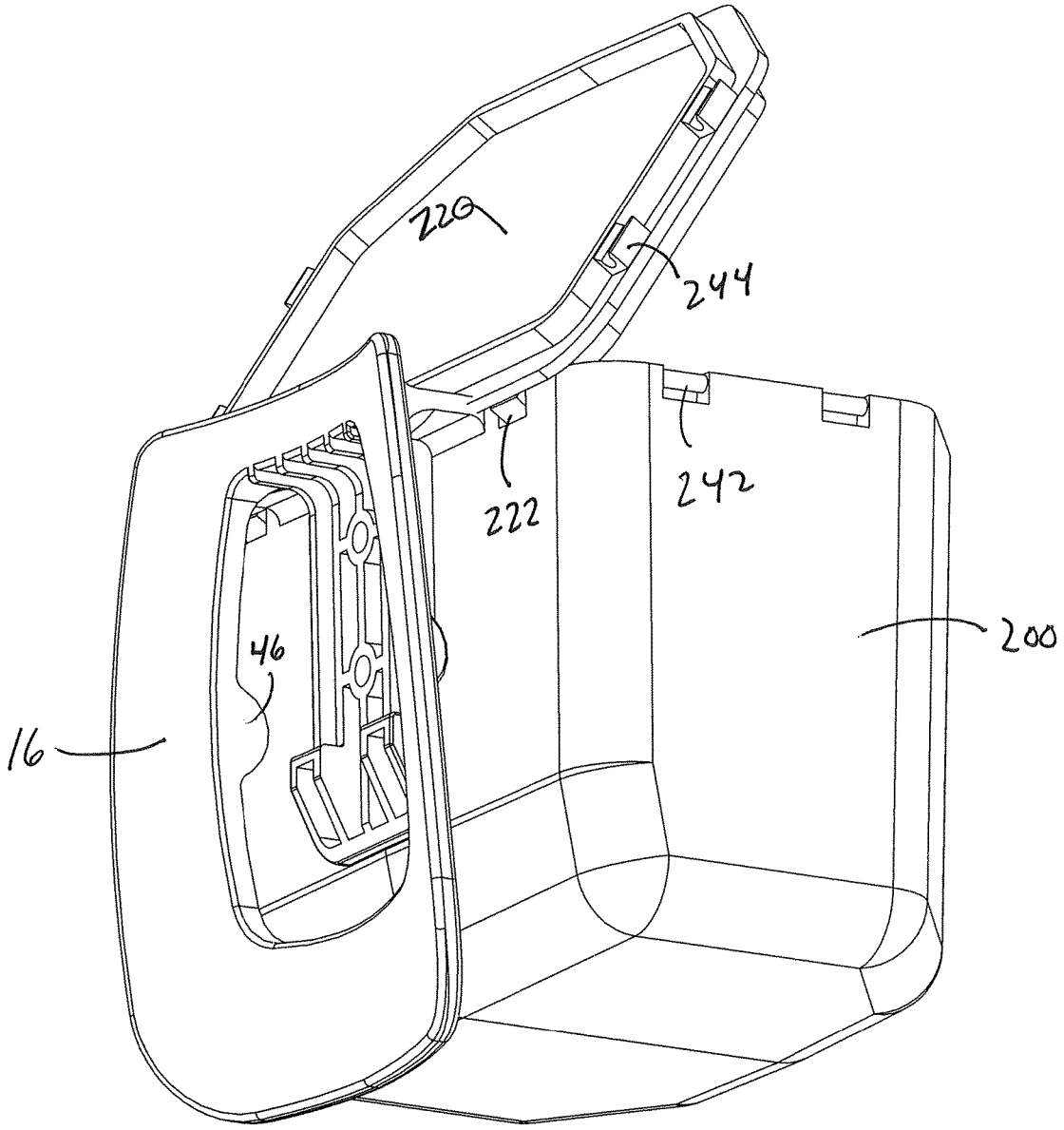
FIG. 30 is a bottom right back perspective view of an embodiment of a tool sack holder of the tool holder of the present invention showing an open lid.
Figure 31:
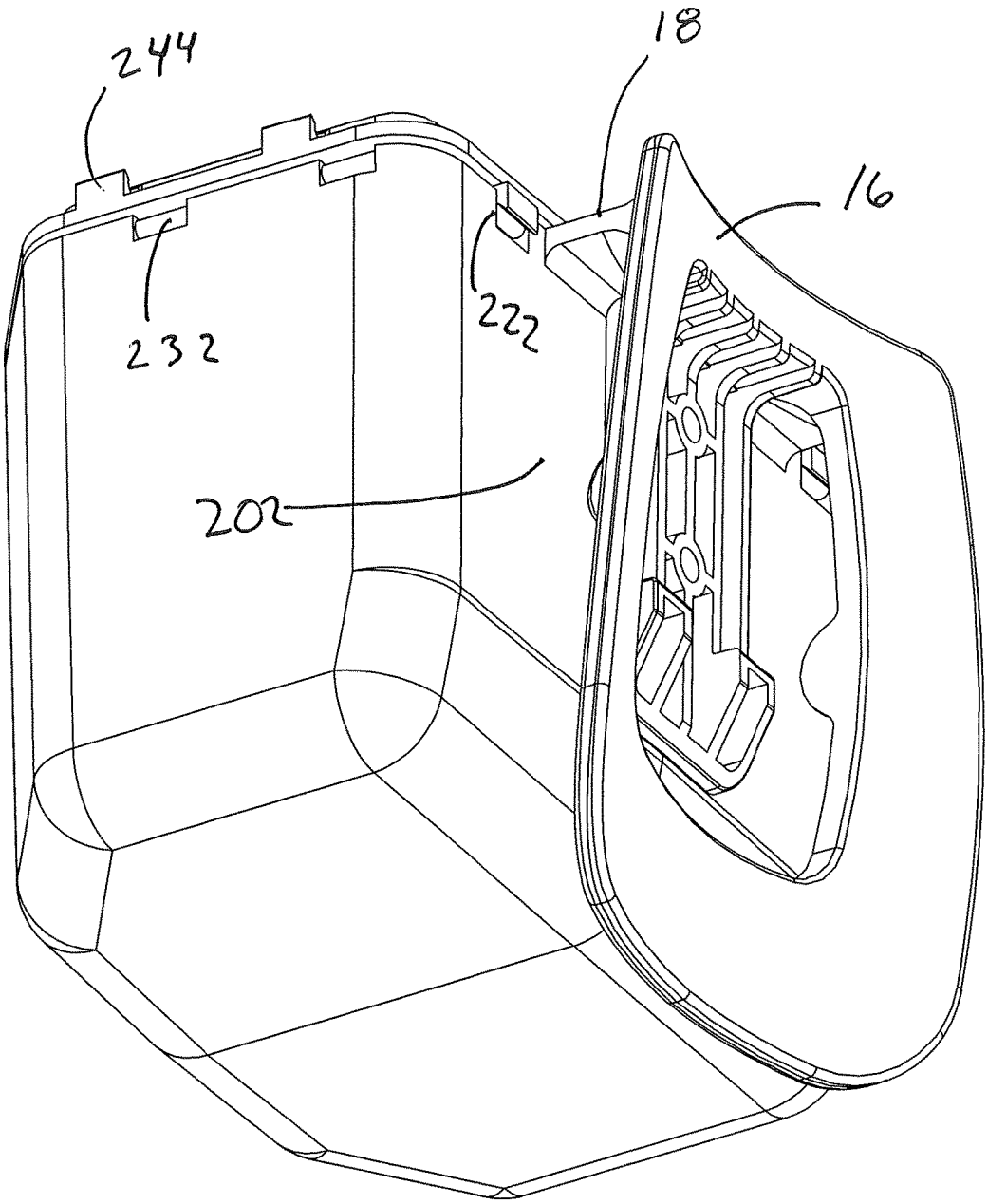
FIG. 31 is a bottom from right perspective view of the tool sack holder of the type shown in FIG. 23.
Figure 32:
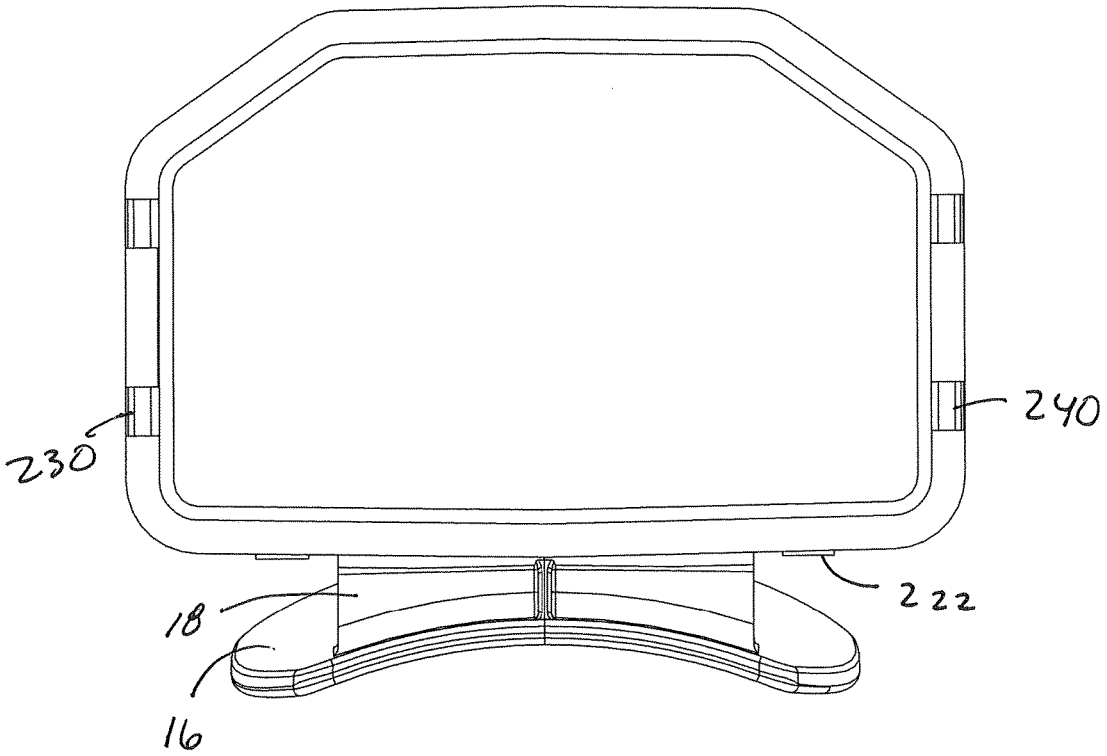
FIG. 32 is a top perspective view of the tool sack holder of the type shown in FIG. 23.
Figure 33:
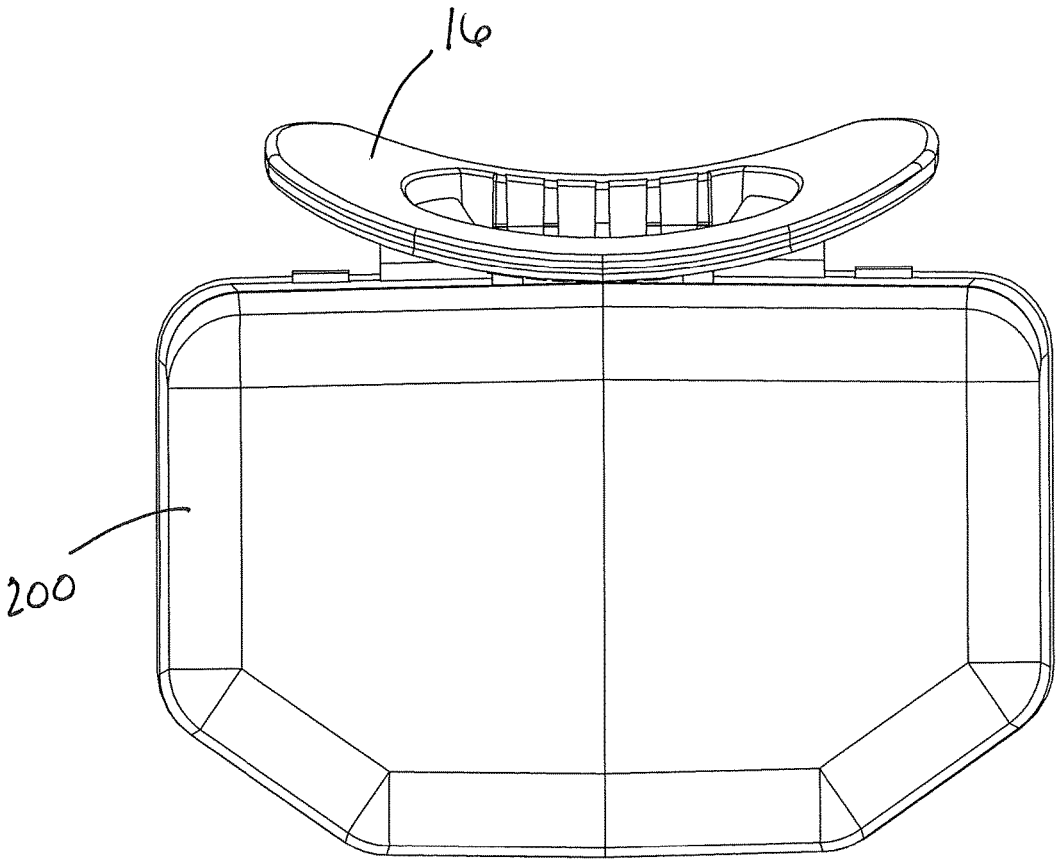
FIG. 33 is a bottom perspective view of the tool sack holder of the type shown in FIG. 23.
Figure 34:
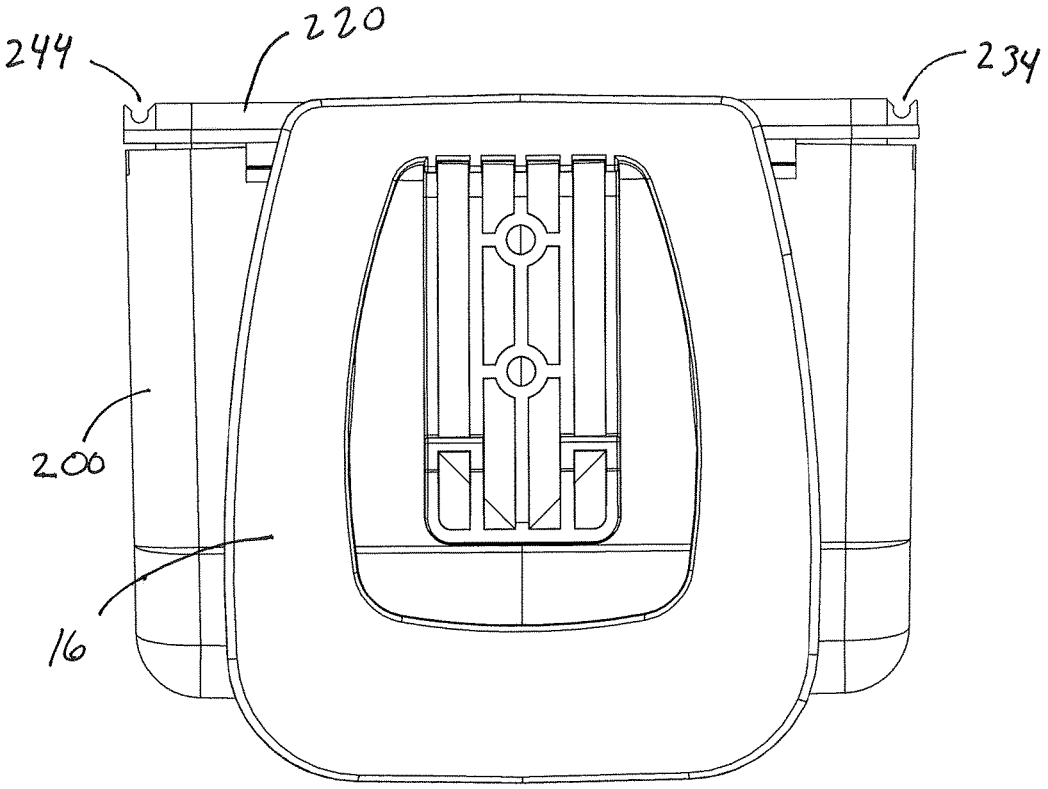
FIG. 34 is a back perspective view of the tool sack holder of the type shown in FIG. 23.
Figure 35:
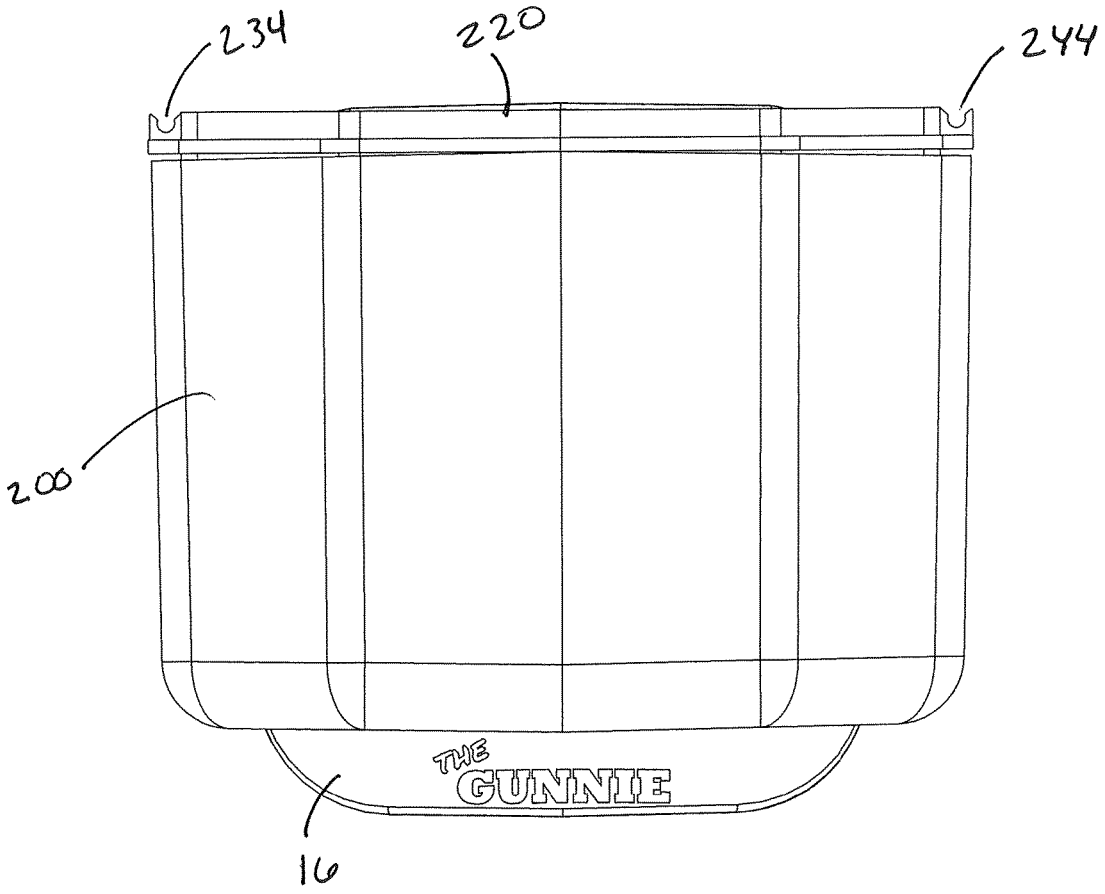
FIG. 35 is a front perspective view of the tool sack holder of the type shown in FIG. 23.
Figure 36:
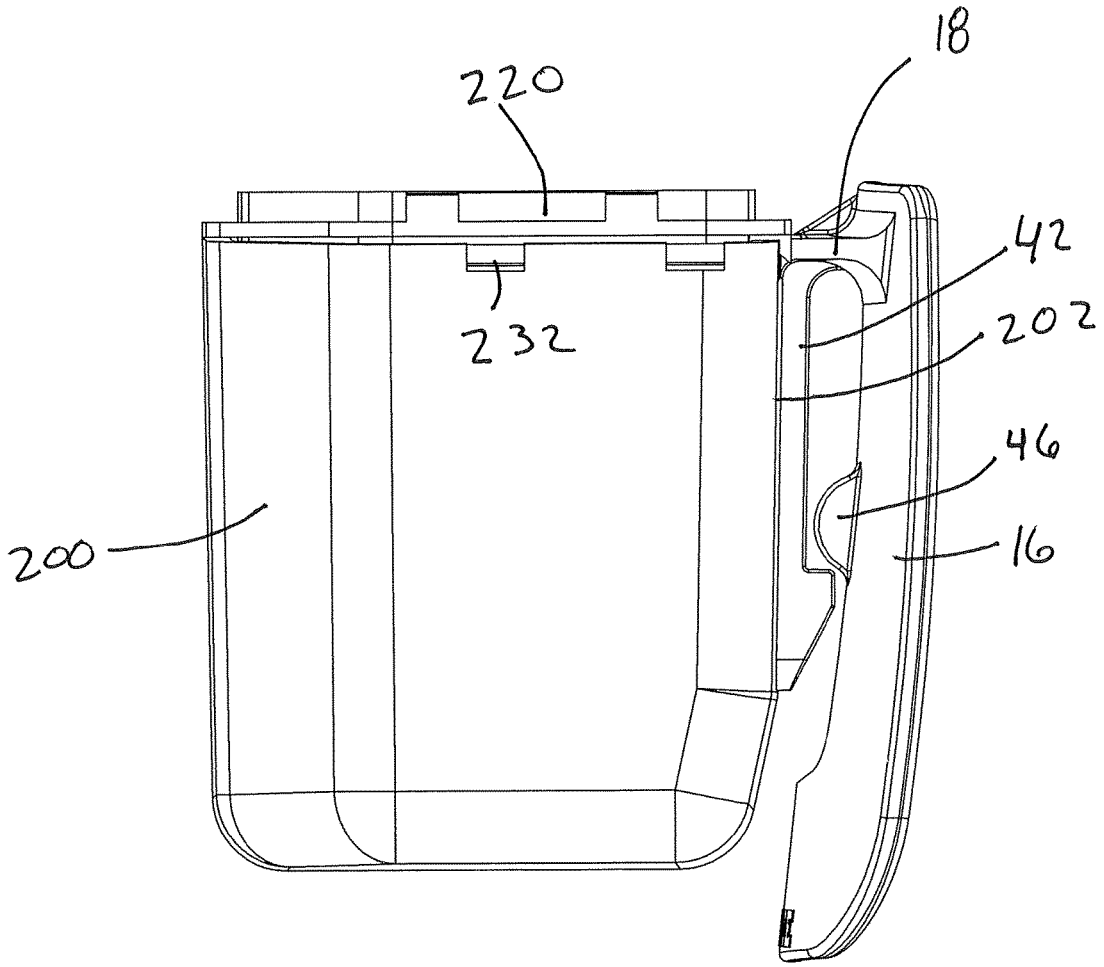
FIG. 36 is a right side perspective view of the tool sack holder of the type shown in FIG. 23.
Figure 37:
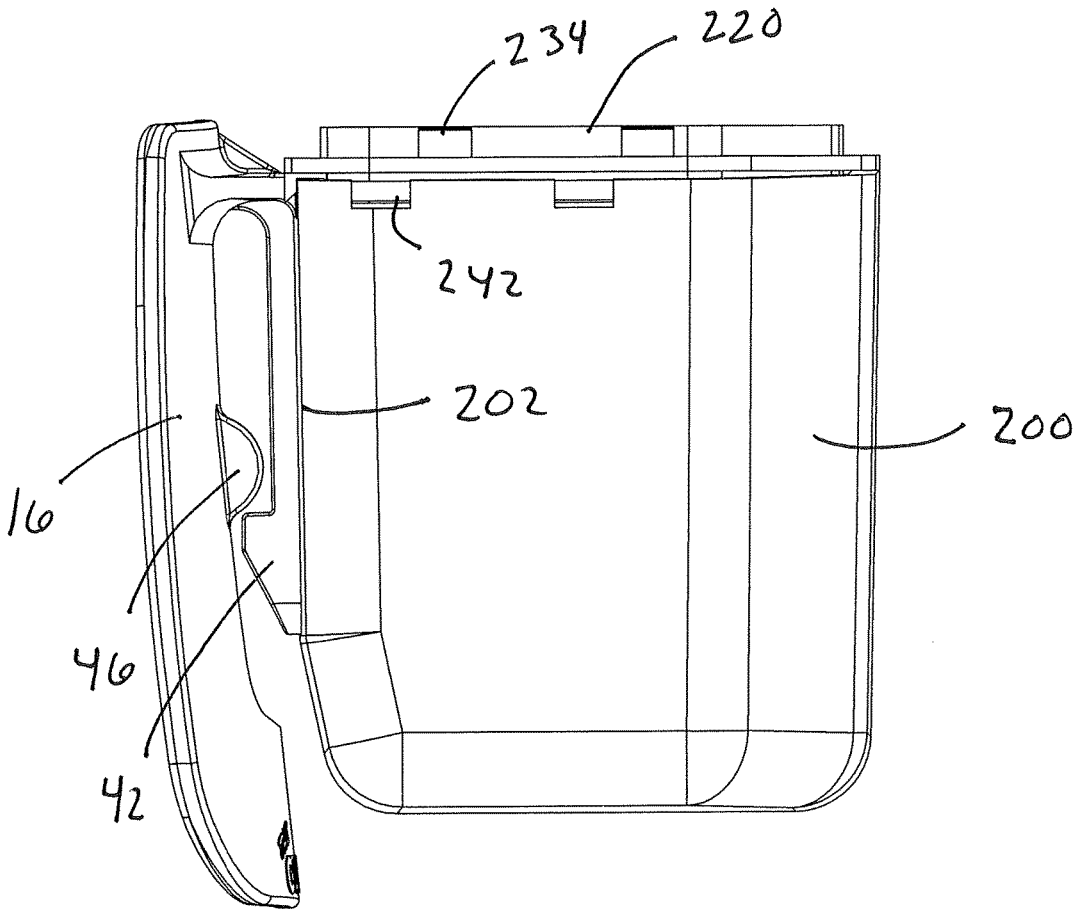
FIG. 37 is a left side perspective view of the tool sack holder of the type shown in FIG. 23.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The apparatus of the present invention is particularly well suited for holding securely a tool, including for example a cordless power tool, from the waist of a user. The tool holder 10 generally includes a tool holder member or saddle 14 and backing member 16. The backing member 16 and holder member 14 are separated in a spaced apart relation by extension member 18. Those skilled in the art will appreciate that the tool holder 14 may take on a variety of configurations and shapes depending upon the various tools intended to be retained within the tool holder.

With reference to FIGS. 1-5, the saddle portion of the tool holder 14 may be generally understood and referred to as "J" shaped and including a straight segment 22 and curved segment 23 that together create a "J" shaped appearance. An end 20 of the curved segment may curve in towards the straight segment 22. The curved segment 23 is preferably made from a resilient polymer that is pliable yet somewhat rigid and tends to return to its original preset shape after bending. Exemplary materials include, without limitation, polyethylene, polypropylene, and nylon based polymer compositions.

The tool retaining end 20 may include an outer extending rib 32 and inner extending rib 34. The outer rib 32 may be contoured and angled to provide a gripping surface suitable for a user to press its thumb against to apply an outwardly prying force directed against the curved segment 23. The inner rib 34 creates a ridge to further reduce a width 28 between tool retaining end 20 and the straight segment 22. Without limitation, the curved segment is preferably substantially round, circular, or another curve that tends to mirror the shape of handles of cordless tools. Further, the maximum width or diameter 30 of the curved segment is larger than the width 28 near the open tool retaining end 20.

Figure 38:
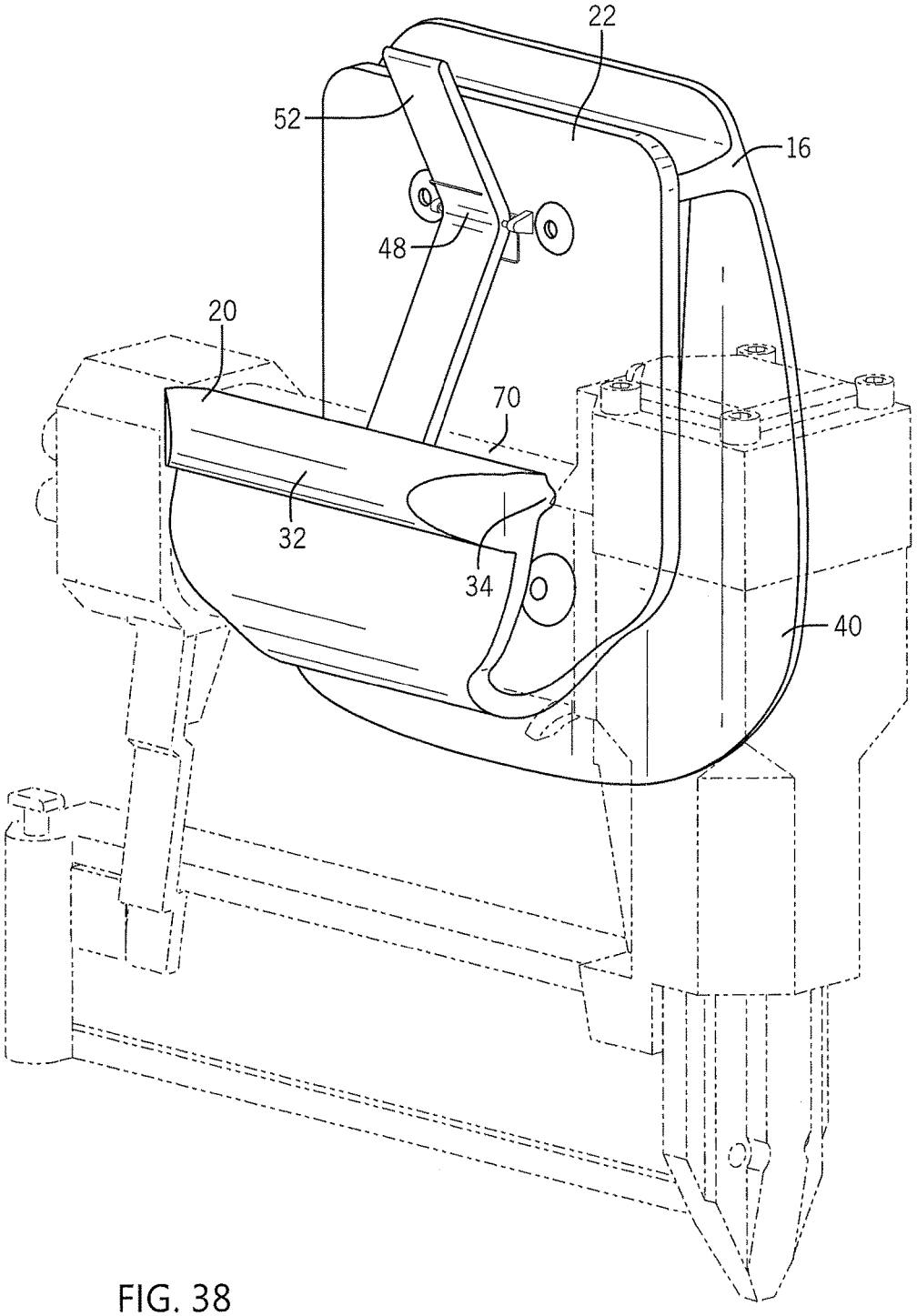
FIG. 38 is a front perspective view of an embodiment of a tool saddle holder of the present invention and showing a tool (not drawn to scale) inserted in the saddle.
Figure 39:
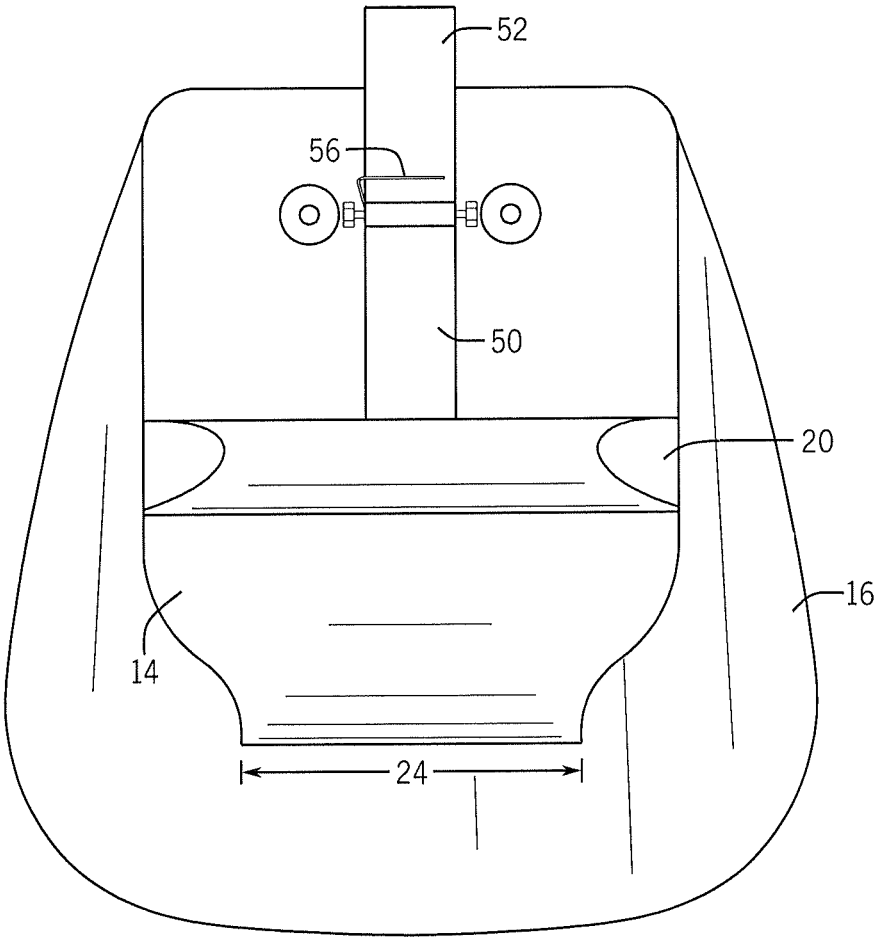
FIG. 39 is a front view of an embodiment of a tool saddle holder of the present invention.
Figure 40:
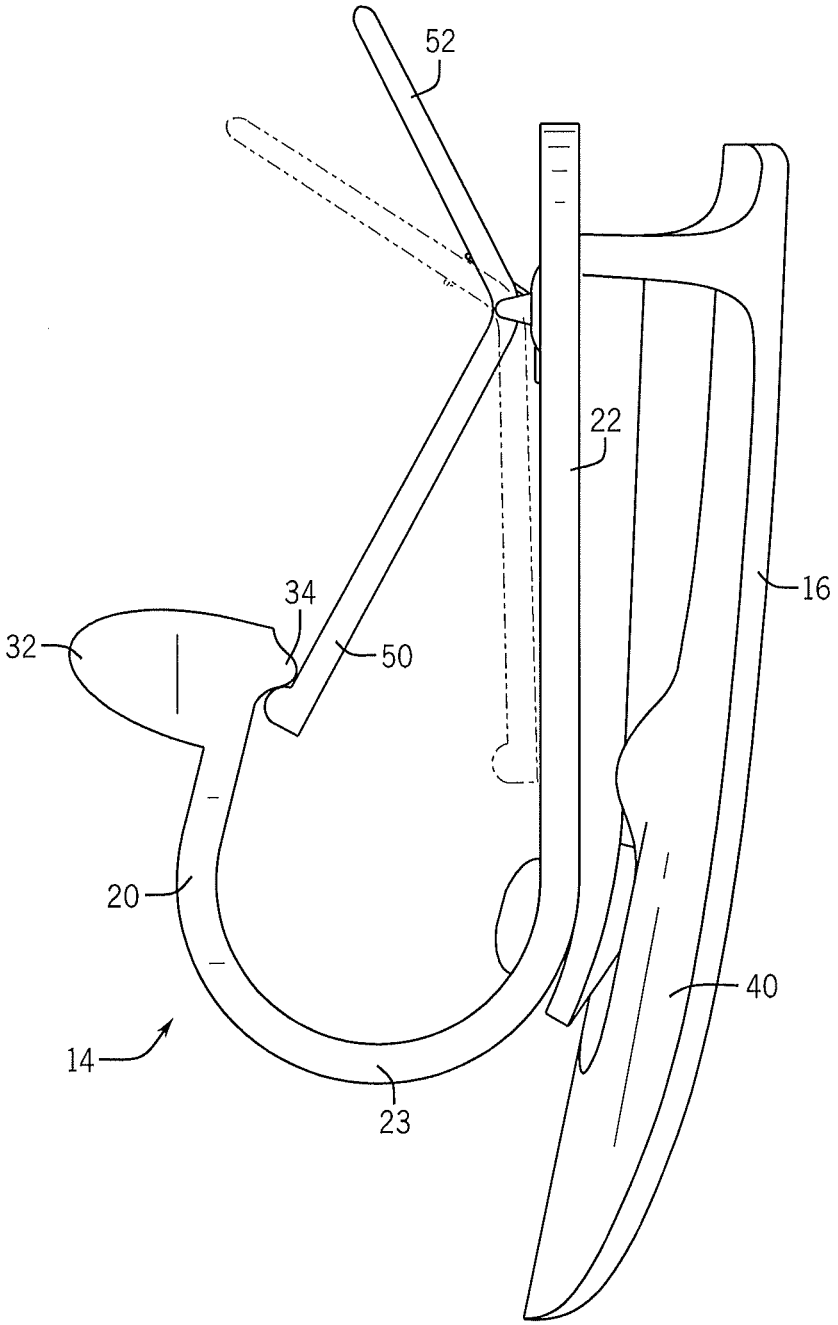
FIG. 40 is a side view of an embodiment of a tool saddle holder of the present invention illustrating the tool flap and lever in the open and closed position.
Figure 41:
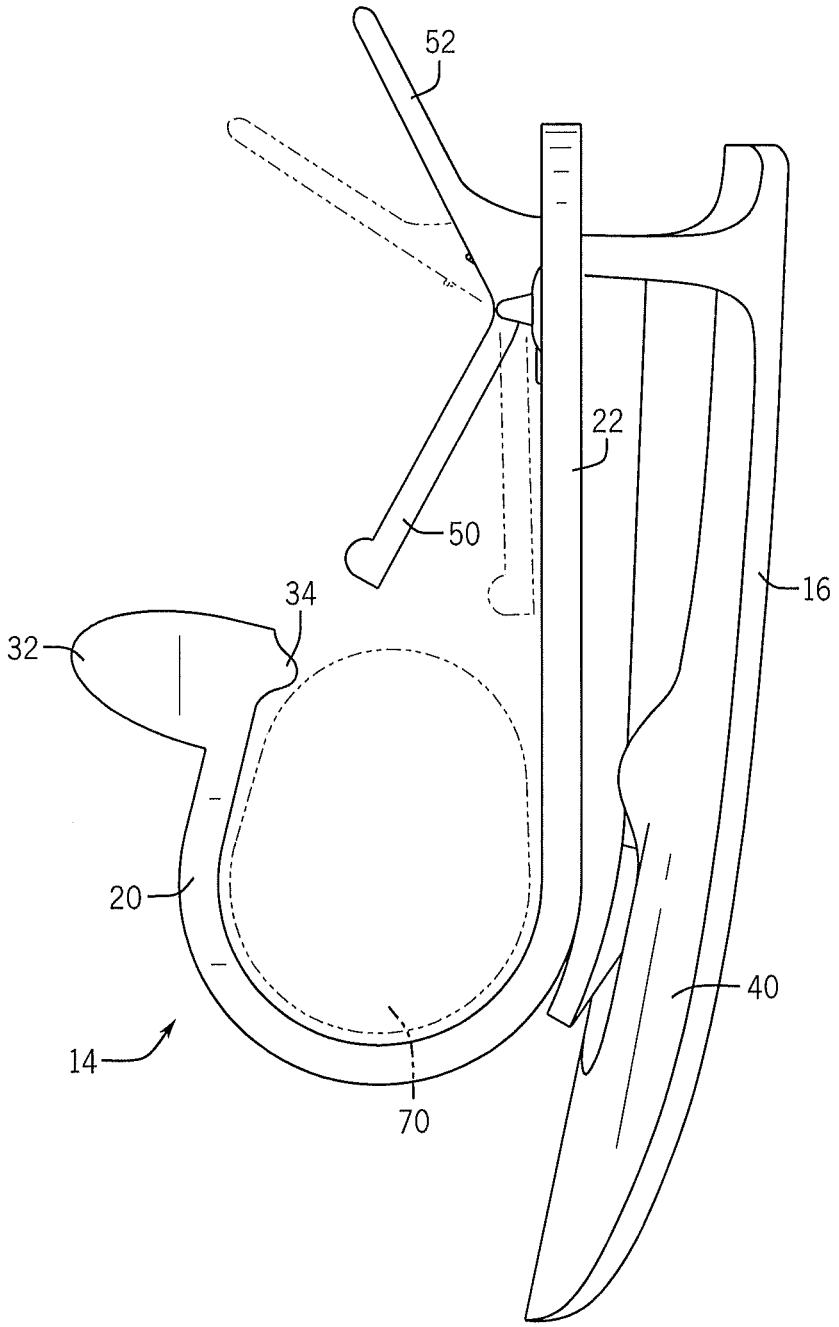
FIG. 41 is a side view of an embodiment of a tool saddle holder of the present invention illustrating the tool flap and lever in the open and closed position with a section of a tool handle illustrated with dotted lines.

In this manner the curved segment may be bent outwards to enlarge the opening to receive a power tool handle and once the handle is placed into the saddle the resilient curved segment 23 tends to grip and clamp against the tool handle. When considering the present invention it will be appreciated that a power tool head and battery pack are not always designed to extend at 90 degrees from the tool handle. To further facilitate a complete seating of a power tool handle within the saddle 14, the bottom width 24 of the saddle may be less than the outer width or maximum width 26 of the saddle. The bottom width 24 may further approximate the distance between the battery pack and trigger of the power tool (see, for example, FIGS. 2 and 38-39).

Backing member or paddle 16 may be attached with an extension member 18 to the straight segment 22 of saddle 14 or may be formed integral with the saddle. The backing may be attached with rivets, screws, or other fasteners of known suitable construction. Alternatively, the Backing member 18 may be coupled to the extension member using a tongue and groove, or other that know joint allowing attachment and removal of the tool holder 14 and extension member 18 from the backing member 16. The backing member or paddle 16 may include a profiled contour or curve 40 to complement a curvature of the user's leg or hip to further provide stability when hung from a belt or waist of the user and to further reduce swaying of the saddle as the user moves. The backing 16 may further include quick release clips 42 that allow for easy mounting and removal of the backing 16 to a belt or pants of a user.

FIGS. 6-12 illustrates a tool holder 10 particularly well suited to hold and retain a hammer. The tool holder includes a tool holder member 14 and backing member 16 coupled together by extension member 18. The tool holder member takes the form of a hammer loop 100 and straight segment 102 that is coupled to extension member 18 (or formed integral therewith). End portions 102 and 104 of the loop 100 include upward extending ramps 110 and 112 and inwardly extending ramps 116 and 118. The loop 100 together with the side segment 102 and ramps 110, 112, 116, and 118 form a tool engaging portion of the tool holder member 14. When the handle of a hammer is dropped into an opening or upper open end of the loop 100, the head of the hammer slides down ramps 110 and 112. The inwardly extending ramps 116 and 118 further reduces the swaying of the hammer head when the hammer head rests on the upper edge 120 of the hammer loop 100. The side 102 includes tabs 46 that further separate the side from the backing member 16.

FIGS. 13-22 illustrates a tool holder 10 particularly well suited to hold and retain a speed square or framer square 152. The tool holder includes a tool holder member 14, backing member 16 and extension member 18. The tool holder member takes the form of a tool engaging pocket 150 having a straight back side 158 coupled to the extension member 18 (or formed integral therewith). The tool engaging pocket 150 has an open end 156. Tapered sides 160 and ends 162 extend downward and transition into tool engaging sides 164 and ends 166. Engaging portions of the tool holder 14 includes sides 158, 160 and 164 and ends 162 and 166. At least a portion of the tool engaging pocket 150 is shaped to mirror a shape of framing square 152. A band 170 extends from an end 162 of the tool engaging pocket and is sized and shaped to be particularly well suited to hold a pencil or pen press fit into the band 170.

FIGS. 23-37 illustrates a tool holder 10 particularly well suited to hold and retain loose objects, including without limitation, screws and nails. The tool holder includes a tool holder member 14, backing member 16 and extension member 18. The tool holder member takes the form of a tool container 200 having a straight back side 202 coupled to the extension member 18 (or formed integral therewith). The container includes a front side 206, back side 208, ends 210 and 212 and bottom 214. A reversible, removable cover 220 is attached to the container 200 with hinge joints. The cover 220 and container 200 together include a back hinge joint set 222, a first side hinge joint set 230 and a second side hinge joint set 240. The back hinge joint set has a container half 224 and a cover half 226 of the joint. The two halves 224 and 226 snap together and allow the cover 220 to be pivoted about the joint created by the hinge 222. The container half 224 is formed on a top edge 216 of the container. The cover half 226 is formed on a bottom side of the cover.

Similarly, the first side hinge joint 230 includes a container half 232 formed in the container and a cover half 234 formed in the cover. The two halves 232 and 234 snap together and allow the cover 220 to be pivoted about the joint created by the hinge 230. The container half 232 is formed on a top edge 216 of the container. The cover half 234 is formed on a top side of the cover. The second side hinge joint 240 likewise includes a container half 242 formed in the container and a cover half 244 formed in the cover. The two halves 242 and 244 snap together and allow the cover 220 to be pivoted about the joint created by the hinge 240. The container half 242 is formed on a top edge 216 of the container. The cover half 244 is formed on a top side of the cover.

When the back hinge joint 222 is engaged, the container halves 232, 242 of joint hinges 230 and 240 point upwards and are disengaged from the container. Alternatively, a user may unsnap the back hinge 222, flip the cover 220 over and engage the side hinges. The user may then unsnap one of the side hinges 230 or 240 and rotate the cover to a desired side of the container. Those skilled in the art will appreciate that other suitable hinges may be formed between the container 200 and cover 220. For example without limitation intended, when the user desires a permanent attachment between the cover and container a living hinge of know suitable construction could be molded and formed between the container and cover.

In another embodiment according to aspects of the invention, and in reference to FIGS. 38-41, the saddle 14 may further include a retaining mechanism 48. The retaining mechanism 48 includes a lever arm 52 and tool flap 50. The lever and flap pivot or rotate on pivot pin 54 and is biased to a closed position by biasing spring 56. The user may press against lever 52 to rotate the flap 50 to the open position to either remove a tool handle from the saddle or to receive the tool handle inserted into the saddle 14.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A tool holder apparatus, said apparatus comprising:

a backing member having a front surface, back surface and side surfaces interconnecting the front surface and back surface, said back surface including a concave curvature extending between the side surfaces of said backing member, wherein said concave curvature is further formed and oriented on said back surface to thereby partially surround a hip of a user when hung at the waist of the user;

a tool holder including an opening to receive a tool, said tool holder having an engaging portion of the tool holder capable of containing and contacting a portion of the tool;

an extension member that interconnects said tool holder and said backing member in a spaced apart relation;

a belt hook extending from a back portion of said tool holder towards said backing member, said belt hook having an angled belt receiving end portion opposing said backing member, and said belt hook having a belt retaining recess portion opposing said backing member, wherein said belt retaining recess portion is adaptable to retain a belt between said backing member and said back portion of said tool holder;

a cover;

a first hinge having an upper half of the first hinge formed in a bottom side of the cover and a lower half of the first hinge formed in a top edge of the tool holder; and a second hinge having an upper half of the second hinge formed in a top side of the cover and a lower half of the second hinge formed in the top edge of the tool holder.

2. The apparatus as recited in claim 1, further including tabs extending from said backing member towards said tool holder, wherein said tabs are capable of restricting flexure of a lower portion of said tool holder towards said backing member.

3. The apparatus as recited in claim 1, further including a third hinge having an upper half of the third hinge formed in the top side of the cover and a lower half of the third hinge formed in the top edge of the tool holder.

4. The apparatus as recited in claim 3, wherein the lower half of the third hinge is formed in a first end of the tool holder at the top edge of the tool holder.

5. The apparatus as recited in claim 4, wherein the lower half of the second hinge is formed in a second end of the tool holder at the top edge of the tool holder.

6. A tool holder apparatus, said apparatus comprising:

a backing member having a front surface and a back surface, wherein a perimeter of said front surface and back surface define a length and width of said backing member, wherein the back surface includes a concave curvature oriented along the width of the backing member such that vertices of curves of the curvature align together along an axis extending between a top and bottom of the backing member;

a tool holder including an opening to receive a tool, said tool holder including an engaging portion of the tool holder, said engaging portion capable of surrounding and contacting a portion of the tool;

an extension member that interconnects said tool holder and said backing member in a spaced relation;

a belt hook extending from a back portion of said tool holder towards said backing member, said belt hook having an angled belt receiving end portion opposing said backing member, and said belt hook having a belt retaining recess portion adaptable to retain a belt in the belt retaining recess portion, wherein said angled belt receiving end portion directs the belt towards the belt receiving recess portion;

tabs extending from said backing member towards said tool holder, wherein said tabs are capable of restricting flexure of a lower portion of said tool holder towards said backing member; and a cover having a first set of hinge members extending from a first side of the cover and the cover further includes a second set of hinge members extending from a second side of the cover.

7. A tool holder apparatus, said apparatus comprising:

a backing member having a front surface and a back surface, wherein the back surface includes a concave curvature having a length and width wherein the width of the concave curvature aligns with a width of said backing member;

a holder including sides, ends, a closed bottom and an open top, wherein an open interior of said holder is bounded by said sides, end, bottom and top;

an extension member that interconnects said holder and said backing member in a spaced relation;

a belt hook extending from a back portion of said holder towards said backing member, said belt hook having an angled belt receiving end portion opposing said backing member, and said belt hook having a belt retaining recess portion adaptable to retain a belt between said backing member and said holder; and tabs extending from said backing member towards said holder, wherein said tabs are capable of restricting flexure of a lower portion of said holder towards said backing member;

a cover adapted to engage and enclose the open top of said holder;

a first hinge having an upper half of the first hinge formed in a bottom side of the cover and a lower half of the first hinge formed in a top edge of the holder; and a second hinge having an upper half of the second hinge formed in a top side of the cover and a lower half of the second hinge formed in the top edge of the holder.

8. The apparatus as recited in claim 7, wherein the top edge of the holder comprises four edge portions and the lower half of the first hinge is formed in the edge portion of the holder proximate the extension member.

9. The apparatus as recited in claim 7, further including a third hinge having an upper half of the third hinge formed in the top side of the cover and a lower half of the third hinge formed in the top edge of the holder.

10. The apparatus as recited in claim 9, wherein the lower half of the third hinge is formed in a first end of the ends of the holder at the top edge of the holder.

11. The apparatus as recited in claim 10, wherein the top edge of the holder comprises four edge portions and the lower half of the first hinge is formed in the edge portion of the holder proximate the extension member.

12. The apparatus as recited in claim 10, wherein the lower half of the second hinge is formed in a second end of the ends of the holder at the top edge of the holder.

13. The apparatus as recited in claim 12, wherein the top edge of the holder comprises four edge portions and the lower half of the first hinge is formed in the edge portion of the holder proximate the extension member.

* * * * *